US009806455B2

(12) United States Patent
Hamada et al.

(10) Patent No.: US 9,806,455 B2
(45) Date of Patent: Oct. 31, 2017

(54) CONNECTOR WATERPROOFING STRUCTURE

(71) Applicants: YAZAKI CORPORATION, Tokyo (JP); HONDA MOTOR CO., LTD., Tokyo (JP)

(72) Inventors: Keiji Hamada, Utsunomiya (JP); Tomoyuki Miyakawa, Utsunomiya (JP); Kazuyuki Ochiai, Wako (JP); Masaki Imamura, Makinohara (JP)

(73) Assignees: YAZAKI CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/052,052

(22) Filed: Feb. 24, 2016

(65) Prior Publication Data

US 2016/0248192 A1 Aug. 25, 2016

(30) Foreign Application Priority Data

Feb. 25, 2015 (JP) ..... 2015-034862
Feb. 25, 2015 (JP) ..... 2015-034866
(Continued)

(51) Int. Cl.
*H01R 13/52* (2006.01)
*H01R 13/627* (2006.01)
(Continued)

(52) U.S. Cl.
CPC ..... *H01R 13/5219* (2013.01); *H01R 13/6272* (2013.01); *H01R 24/20* (2013.01); *H01R 24/28* (2013.01); *H01R 2103/00* (2013.01)

(58) Field of Classification Search
CPC ..... H01R 13/5202; H01R 13/5219; H01R 13/5221
(Continued)

(56) References Cited

U.S. PATENT DOCUMENTS 3,880,487 A 4/1975 Goodman et al.
3,945,701 A * 3/1976 Boeke ..... H01R 13/523 439/281
(Continued)

FOREIGN PATENT DOCUMENTS

JP 50-27092 A 3/1975
JP 50-70886 A 6/1975
(Continued)

OTHER PUBLICATIONS

Japanese Office Action for the related Japanese Patent Application No. 2015-034866 dated Jun. 30, 2017.
(Continued)

*Primary Examiner* — Ross Gushi
(74) *Attorney, Agent, or Firm* — Kenealy Vaidya LLP

(57) ABSTRACT

A connector waterproofing structure watertightly seals a gap between openings of cavities of a pair of housings which accommodate terminals. In the structure, the pair of housings includes annular members formed at each of ends of the openings. The annular members are made of resin, protrude and surround the openings, either one of the annular members is formed into such a shape to be pressed to an inner peripheral surface or an outer peripheral surface of the opposite annular member, when the pair of housings are fitted together, and the inner peripheral surface or the outer peripheral surface are obliquely formed so that the wall thickness of the opposite annular member is gradually increased from the distal end toward the back.

17 Claims, 37 Drawing Sheets

(30) Foreign Application Priority Data

| | | |
|---|---|---|
| Feb. 25, 2015 | (JP) | 2015-034867 |
| Feb. 27, 2015 | (JP) | 2015-039348 |
| Sep. 16, 2015 | (JP) | 2015-183326 |

(51) Int. Cl.
*H01R 24/20* (2011.01)
*H01R 24/28* (2011.01)
*H01R 103/00* (2006.01)

(58) Field of Classification Search
USPC ..... 439/278, 283, 281, 282, 587–589
See application file for complete search history.

(56) References Cited

U.S. PATENT DOCUMENTS

| | | | | |
|---|---|---|---|---|
| 4,886,471 | A | 12/1989 | Fleshman, Jr. | |
| 5,580,266 | A * | 12/1996 | Shelly | H01R 13/53 439/281 |
| 6,336,821 | B1 * | 1/2002 | Hattori | H01R 13/6277 439/282 |
| 7,553,186 | B2 * | 6/2009 | Morikawa | H01R 13/5208 439/587 |
| 2001/0041470 | A1 | 11/2001 | Makita | |

FOREIGN PATENT DOCUMENTS

| | | | |
|---|---|---|---|
| JP | 3-22366 | U | 3/1991 |
| JP | 11-121083 | A | 4/1999 |
| JP | 3065582 | U | 2/2000 |
| JP | 2001-319725 | A | 11/2001 |
| JP | 2013-51071 | A | 3/2013 |
| JP | 2013-229168 | A | 11/2013 |
| JP | 2013-239367 | A | 11/2013 |
| JP | 2013-239368 | A | 11/2013 |
| WO | 2011/076601 | A1 | 6/2011 |
| WO | 2013/161341 | A1 | 10/2013 |

OTHER PUBLICATIONS

Japanese Office Action for the related Japanese Patent Application No. 2015-034867 dated Jun. 20, 2017.
Japanese Office Action for the related Japanese Patent Application No. 2015-039348 dated Jun. 20, 2017.
Japanese Office Action for the related Japanese Patent Application No. 2015-183326 dated Aug. 1, 2017.
Japanese Office Action for the related Japanese Patent Application No. 2015-034867 dated Sep. 7, 2017.

* cited by examiner

CONNECTOR WATERPROOFING STRUCTURE

CROSS REFERENCE TO RELATED APPLICATION

This application is based on Japanese Patent Applications Nos. 2015-034862 filed on Feb. 25, 2015, 2015-034866 filed on Feb. 25, 2015, 2015-034867 filed on Feb. 25, 2015, 2015-039348 filed on Feb. 27, 2015 and 2015-183326 filed on Sep. 16, 2015, the contents of which are incorporated herein by reference.

BACKGROUND OF THE INVENTION

1. Technical Field

The present invention relates to a connector waterproofing structure.

2. Background Art

Traditionally, a waterproofing connector which is connected between electric wires is loaded in an automobile or the like. For example, a connector is known which includes a female connector and a male connector and which is formed by making the two connectors fitted together. The female connector has a tubular inner housing which is formed with a cavity which can accommodate female terminals and a tubular outer housing which surrounds the inner housing. The male connector has a tubular male housing which is formed with a cavity which can accommodate male terminals.

In this kind of connector, an annular rubber packing is mounted to the outer peripheral surface of the inner housing of the female connector. When the two connectors are fitted together, because the male housing is inserted into a gap between the inner housing and the outer housing of the female connector, and the packing adheres to the outer peripheral surface of the inner housing and the inner peripheral surface of the male housing, respectively, water is prevented from invading the gap between the cavities.

However, for this kind of waterproofing structure, because a space to mount the packing to the inside of the female connector is necessary, there is a problem which is that the outer diameter of the connector is increased. In contrast, as a waterproofing structure without using the packing, for example, a structure to prevent water invasion is known (for example, JP-A-2013-229168) in which the inner surface at the back side of the female housing is provided with a resin sealing plate which has resilience, and when the two connectors are fitted together, the tubular distal end in the fitting direction of the male housing abuts against the annular sealing plate of the female housing over the entire periphery.

Further, a waterproofing connector which is loaded in an automobile or the like and connected between electric wires is constructed by making a tubular male housing, which is formed with a cavity which can accommodates male terminals, fitted inside a tubular female housing which is formed with a cavity which can accommodate female terminals. For example, by making an annular waterproofing rubber which is mounted onto the outer peripheral surface of the male housing adhere to the inner peripheral surface of the female housing, a gap between the opening ends of the cavities of the two housings is watertightly sealed (for example, JP-A-2013-051071).

According to the waterproofing structure of JP-A-2013-229168, when the male housing is abutted against the sealing plate, an excessive load may occur in at least one of the two housings. For example, when the male housing is pressed against the sealing plate while a dimensional error above a predetermined level occurs in one housing, and a foreign object or the like attaches to the gap between the male housing and the sealing plate, the male housing deforms plastically beyond the elastic limit, and waterproofness may drop.

The present invention is made in view of such a problem, and the first object of the present invention is to provide a connector waterproofing structure which can improve waterproofness by preventing the plastic deformation of the connector when the housings are fitted together, and which enables the downsizing of the connector.

For the connector described in JP-A-2013-051071, under a long time severe condition, the waterproofing rubber thermally expands, and may jump outward from the gap between the housings. When, for example, high pressure washing water or the like is blown against the waterproofing rubber which jumps outward in this way, the exposed waterproofing rubber may be rolled up by the water pressure or may be damaged to drop out from the connector. In this case, it is concerned that a water invasion space is produced at the waterproofing rubber which is between the housings, and the waterproofness drops.

The present invention is made in view of such a problem, and the second object of the present invention is to prevent the waterproofness drop of the connector due to the washing of high pressure water.

For the connector described in JP-A-2013-051071, the waterproofing rubber deteriorates over time due to long time use, and waterproofness may drop. Under the high temperature conditions, for example in summer, the waterproofing rubber which thermally expands may jump out from the gap between the housings, and when high pressure water for washing is blown against the waterproofing rubber, the waterproofing rubber may be rolled up, and the internal waterproofing rubber may be damaged, leading to a waterproofness drop.

Further, for the above-mentioned waterproofing connector, the pressure in the cavities may become a negative pressure due to a temperature difference from the outside temperature or the like. In this case, when the waterproofing rubber deteriorates over time or is damaged, water may invade the inside of the cavities from the outside of the connector.

The present invention is made in view of the above problems, and the third object of the present invention is to prevent water from invading inside even if the pressure inside the cavities becomes a negative pressure.

For the connector described in JP-A-2013-051071, because an accommodating space of the waterproofing rubber is necessary in the gap between the male housing and the female housing, there is a problem of upsizing the connector. Under the high temperature conditions, for example, in summer, the waterproofing rubber which thermally expands may jump out from the gap between the housings, and when high pressure water for washing is blown against the waterproofing rubber, the waterproofing rubber may be rolled up, and the internal waterproofing rubber may be damaged, leading to a waterproofness drop.

The present invention is made in view of the above problems, and the fourth object of the present invention is to prevent the waterproofness of the connector from dropping when high pressure water is blown at the time of washing with the high pressure water.

SUMMARY OF THE INVENTION

According to an aspect of the invention for addressing the above first object, a connector waterproofing structure watertightly seals a gap between openings of cavities of a pair of housings which accommodate terminals. In the structure, the pair of housings includes annular members formed at each of ends of the openings. The annular members may be made of resin, protrude and surround the openings, either one of the annular members is formed into such a shape to be pressed to an inner peripheral surface or an outer peripheral surface of the opposite annular member, when the pair of housings are fitted together, and the inner peripheral surface or the outer peripheral surface are obliquely formed so that the wall thickness of the opposite annular member is gradually increased from the distal end toward the back.

Accordingly, the annular member of one housing is pressed to the inclined surface of the inner peripheral surface or the outer peripheral surface of the annular member of the other housing to deform elastically, and presses the inner peripheral surface or the outer peripheral surface of the annular member of the other housing by a restoring force of the elastic deformation that occurs at this time. Thereby, because the annular members of the pair of housings are pressed and adhered to each other in an elastic limit, without making the connector deform plastically; it can be prevented that water invades the openings, and the waterproofness of the connector can be improved. Because a space where the rubber packing is provided becomes unnecessary by making the annular members contact each other directly, the downsizing of the connector can be implemented.

A distal end of either of the annular members at a surface opposed to the opposite annular member may be formed obliquely in a direction away from the opposite annular member.

Because a corner is formed over the entire periphery at the distal end by inclining the distal end of the one annular member in this way, even if, for example, the one annular member is abutted obliquely against the opposite annular member, it is possible to make the annular members contact uniformly over the entire periphery.

Either of the annular members may be formed so that the distal end abuts against the housing where the opposite annular member is formed when the pair of housings are fitted together.

Accordingly, because a relative movement of the two annular members can be regulated since the distal end of the one annular member abuts against the opposite housing, damage or the like due to excessive pushing between the annular members can be prevented.

The annular members may be made of resin, protrude and surrounds the openings, either one of the annular members is formed into such a shape to be pressed to an inner peripheral surface or an outer peripheral surface of the opposite annular member, when the pair of housings are fitted together, and the inner peripheral surface or the outer peripheral surface is formed to have an inclined surface in a middle from a distal end toward a base end of the one of the annular members so that the wall thickness of the opposite annular member is gradually increased toward the back.

Accordingly, because an inclined surface is formed in the middle from the distal end of the opposite annular member toward the back, friction does not occur between the two annular members until the one annular member abuts against the inclined surface of the opposite annular member. Therefore, because when the pair of housings are fitted together, the fitting load when one housing is pushed into the housing of the opponent can be reduced, the assembling operativity of the connector can be raised.

The one of the annular members may be formed with an inclined surface which corresponds to the inclined surface when the pair of housings are fitted together.

Accordingly, because it is possible to make the inclined surface of one annular member abut against the inclined surface of the opposite annular member in a way of just pushing, excessive deformation when one annular member pushes the opposite annular member can be prevented, and plastic deformation or damage of the annular member can be prevented.

According to another aspect of the invention for addressing the above second object, a connector waterproofing structure watertightly seals a gap between openings of cavities of a pair of housings which accommodate terminals. In the structure, the pair of housings includes annular members formed at each of ends of the openings. The annular parts may include an inside annular part and an outside annular part which are fitted together with each other at the openings, and one of the housings which has the inside annular part may be formed with a cover body which covers an outer peripheral surface of an distal end of the outside annular part.

Accordingly, because the distal end, which is fitted together with the inside annular part, of the outside annular part is covered with the cover body, it can be prevented that high pressure water contacts the distal end, for example, when the vehicle is washed. Thereby, because an up-rolling of the outside annular part due to the high pressure water can be prevented, the fitted state of the outside annular part and the inside annular part can be maintained, and a waterproofness drop can be prevented. The inside annular part and the outside annular part can be formed as resin members which extend from the pair of housings made of resin, respectively, and a watertight sealing part of the pair of housings can be formed by making the inside annular part and the outside annular part contact each other.

The housing which has the inside annular part may be formed to have an annular groove whose opposed groove side surfaces are formed of the outer peripheral surface of the inside annular part and the inner peripheral surface of the cover body, respectively.

Accordingly, because the present invention can be implemented, for example, by forming the annular groove which the outside annular part enters along the inside annular part at the opening end of the housing comprising the inside annular part, the connector structure can be simplified.

The outer peripheral surface of the inside annular part may be obliquely formed to be widen toward the housing having the outside annular part.

Accordingly, because the inner peripheral surface of the outside annular part is fitted with the inclined outer peripheral surface of the inside annular part over the entire periphery in a way of just pushing axially, the contact state of the outside annular part with the inside annular part can be ensured definitely. If the inclined surface corresponding to the inclined surface of the inside annular part is formed at the inner peripheral surface of the outside annular part, regardless of the axial positional deviation of the outside annular part and the inside annular part, a good contact state of the two annular parts can be ensured.

The outside annular part may abut against the inner peripheral surface of the cover body when the pair of housings is fitted together.

Accordingly, because the distal end of the outside annular part can be clamped between the inside annular part and the cover body, the holding force of the outside annular part can be raised. Therefore, even if high pressure water contacts any place other than the distal end of the outside annular part, a fitted state of the outside annular part and the inside annular part can be maintained more surely.

According to another aspect of the invention for addressing the above third object, a connector waterproofing structure watertightly seals a gap between openings of cavities of a pair of housings which accommodate terminals. In the structure, the pair of housings includes annular members formed at each of ends of the openings. One of the annular parts may be formed into such a shape deformed by a negative pressure inside the cavity and presses the other annular part.

Accordingly, for the opening ends of the pair of cavities, the pair of annular parts made of resin abut against each other, and the inside of the pair of cavities can be watertightly sealed. Therefore, the waterproofing rubber for watertightly sealing becomes unnecessary, and a waterproofness drop due to deterioration over time or damage of the waterproofing rubber can be prevented. Particularly, because the one annular part is formed to flex to push the other annular part when the cavity has a negative pressure, and the pair of annular parts abut strongly against each other, it can be prevented that water invades the cavity of the negative pressure.

Specifically, the one of the annular parts may be formed into an umbrella shape which is widened toward the other annular part, and an inner peripheral surface of the one of the annular parts nay abut against the fringe of the opening end of the other annular part.

In this case, it is desirable that the other annular part is formed to have a rigidity higher than that of the one annular part, and, for example, the opening end of the tubular housing opposed to the one annular part may be the other annular part.

Specifically, the one of the annular part may be formed into an umbrella type which is tapered toward the other annular part, and an distal end of the one of the annular parts abuts against an outer peripheral surface of the other annular part which is widened from the distal end toward a base end of the one annular part.

In this case, it is desirable that the other annular part is formed to have a rigidity higher than that of the one annular part, and, for example, the opening end of the tubular housing opposed to the one annular part may be the other annular part.

In this case, for example, the other annular part may be formed to have a rigidity higher than the one annular part, and the distal end of the one annular part may be formed to abut against the inner peripheral surface of the other annular part.

The pair of annular parts may be formed into such a shape that while distal end surfaces of the pair of annular parts abut against each other, and the pair of annular parts may be deformed to press the opposite annular part when the inside of the cavity has a negative pressure.

Accordingly, because the pair of annular parts flex to push each other when the inside of the cavity has a negative pressure, coherence between the annular parts is raised in comparison with a case when only one annular part is flexed, and waterproofness can be further improved.

According to another aspect of the invention for addressing the above fourth object, a connector waterproofing structure watertightly seals a gap between openings of cavities of a pair of housings which accommodate terminals. In the structure, the pair of housings includes annular members formed at each of ends of the openings. The annular parts may include an inside annular part and an outside annular part which are fitted together with each other at the openings, and the outside annular part may be formed with an inclined inner peripheral surface against which a distal end of the inside annular part is abuttable, and is formed to have a rigidity higher than that of the inside annular part.

Accordingly, because the inside annular part and the outside annular part abut against each other, when the pair of housings are engaged, the gap between the openings of the cavities opposed to each other can be watertightly sealed. Therefore, because the waterproofing rubber for watertightly sealing becomes unnecessary, the downsizing of the connector is enabled and a waterproofness drop due to deterioration over time or damage of the waterproofing rubber can be prevented. Particularly, because the inside annular part is covered with the outside annular part whose rigidity is high, high pressure liquid can be inhibited from contacting at the time of washing with the high pressure liquid. Thereby, because deformation or damage of the inside annular part due to the high water pressure can be prevented, the watertightness of the contact portion with the outside annular part is ensured, and the waterproofness drop of the connector at the time of washing with the high pressure liquid can be inhibited.

The housing where the inside annular part is formed may be formed with a tubular part which surrounds a portion where the inside annular part and the outside annular part abut against each other, and into which the other housing is inserted, the tubular part may be provided with an arm piece which is cut axially and extends forward into a cantilever shape, and the arm piece may formed to have a locking part which engages with the outer peripheral surface of the other housing to lock the housing.

Accordingly, because the outside annular part is provided to extend in a direction opposite to the extending direction of the arm piece, the high pressure liquid that enters from the cut part formed along the arm piece into the tubular part is cut off efficiently by the outside annular part, and it can be prevented that the high pressure liquid is blown against the inside annular part.

According to the present invention, a connector waterproofing structure can be provided which can improve waterproofness by preventing the plastic deformation of the connector when the housings are fitted together, and which enables the downsizing of the connector.

Further, a waterproofness drop of the connector due to washing with high pressure water can be inhibited.

Further, it can be prevented that water invades inside even if the pressure inside the cavities becomes a negative pressure.

Further, a waterproofness drop of the connector when high pressure water is blown at the time of washing with the high pressure water can be inhibited.

BRIEF DESCRIPTION OF DRAWINGS

FIG. 10 is an exploded perspective view of a connector which the present invention is applied to.

DESCRIPTION OF EMBODIMENTS

First Embodiment

The first embodiment of a connector waterproofing structure which the present invention is applied to is described as follows with reference to FIGS. 1 to 8. In this embodiment, a waterproof connector loaded in an automobile or the like is described as an example, but the connector of the present invention also can be applied as a connector of other applications.

Figure 1:
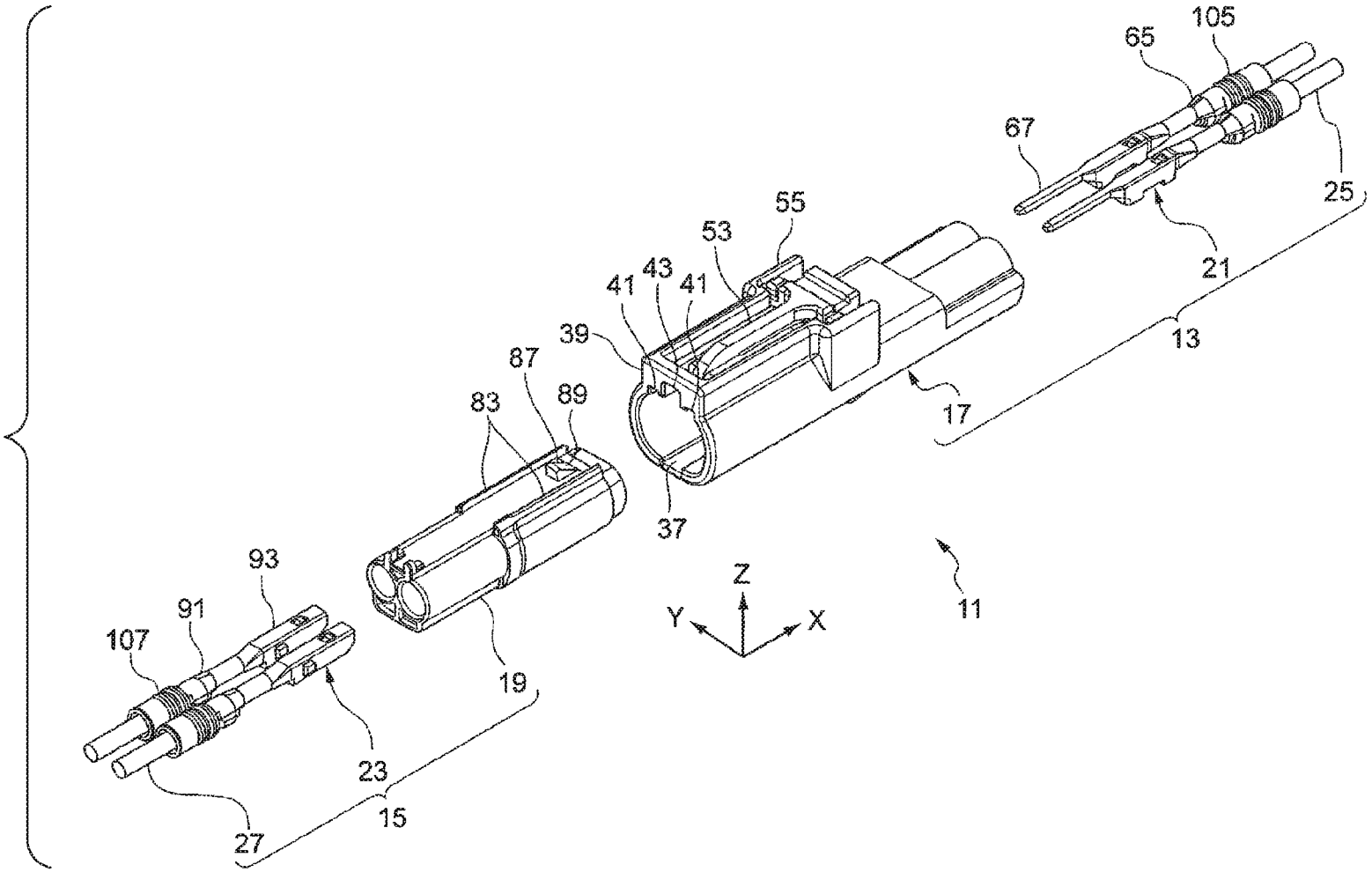
FIG. 1 is an exploded perspective view of a connector of a first embodiment.
Figure 2:
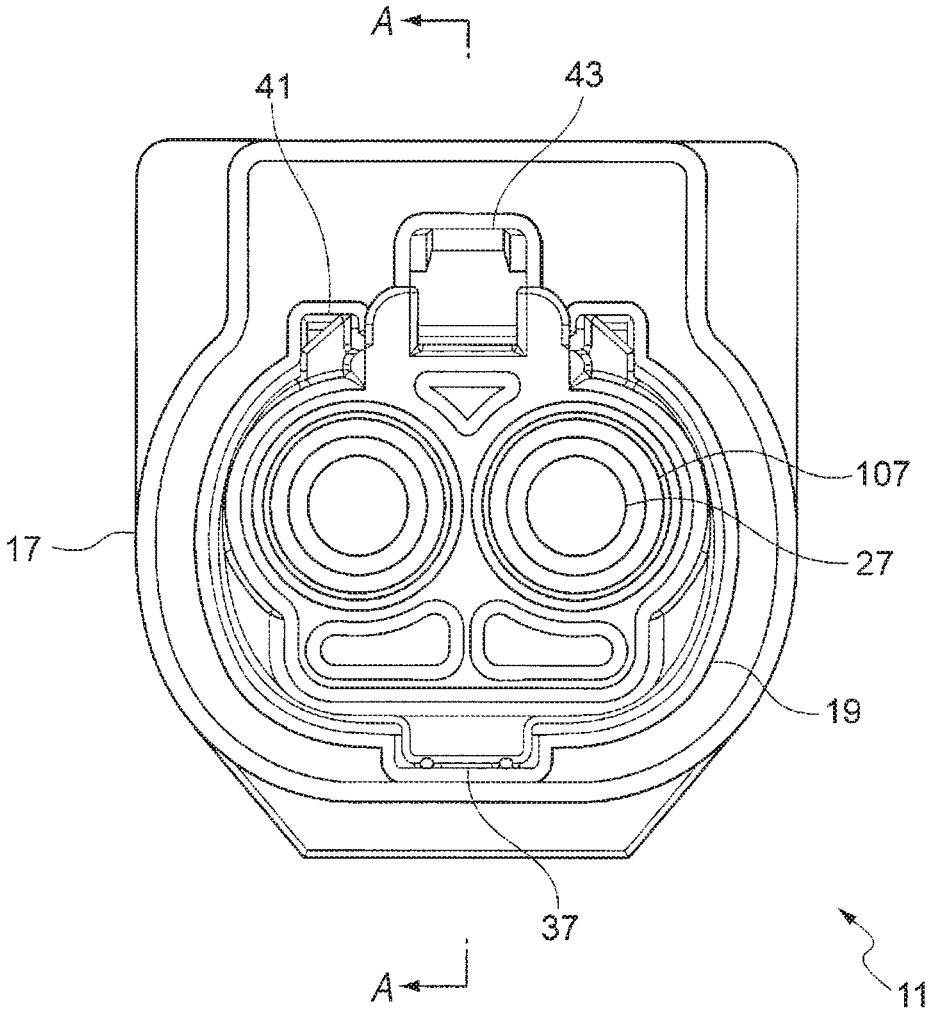
FIG. 2 is a figure of the connector of FIG. 1 when viewed from the back side of a female connector.

As shown in FIGS. 1 and 2, a connector 11 of the present embodiment includes a male connector 13 and a female connector 15, and when a male housing 17 of the male connector 13 and a female housing 19 of the female connector 15 are fitted together with each other, male terminals 21 which are accommodated in the male housing 17 and female terminals 23 which are accommodated in the female housing 19 are electrically connected. Electric wires 25 are connected to the male terminals 21, and electric wires 27 are connected to the female terminals 23. The female housing 19 is fitted into the inside of the male housing 17 to be locked. In this embodiment, an example in which two terminals are accommodated in each connector is described, but the number of the terminals which are accommodated is not limited to two. In the following description, in FIG. 1, the X direction is defined as a forward/backward direction, the Y direction as a width direction, the Z direction as a height direction, and the fitting directions of the two connectors respectively as a forward direction, and the upper side of FIG. 1 is defined as an upside.

Figure 6:
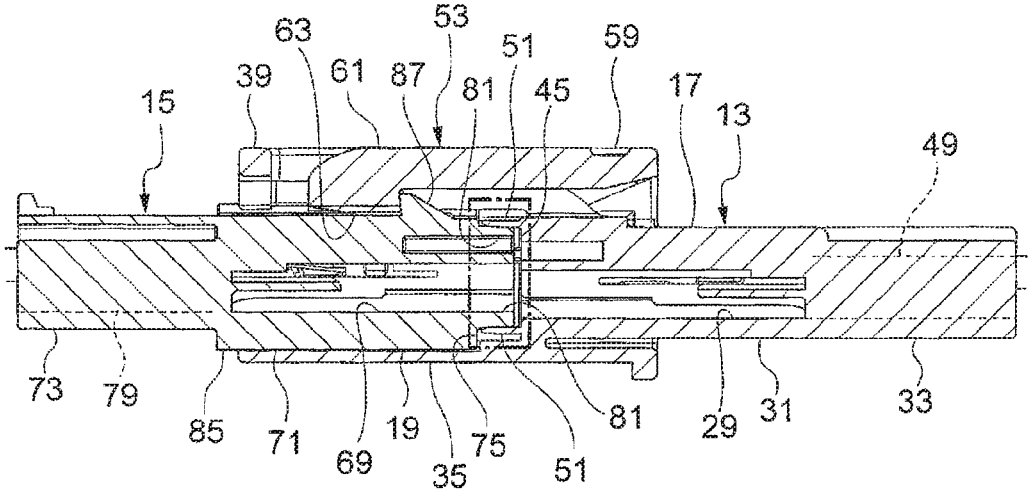
FIG. 6 is an A-A arrow sectional view of FIG. 2.

As shown in FIG. 1, the male connector 13 has the male housing 17, which is formed of insulative synthetic resin into a cylindrical shape, and the male terminals 21, which are accommodated in the male housing 17 from the back side. As shown in FIG. 6, the male housing 17 is formed by integrally including a tubular base 31 in which a male terminal accommodating room 29 (cavity), in which the male terminals 21 are accommodated, is formed, an electric wire holding part 33 which projects backward from the base 31, and a hood part 35 which projects forward from the base 31. The hood part 35 is formed to have a peripheral wall which extends from the peripheral wall of the base 31, and is formed into an oval cylindrical shape whose cross section perpendicular to the axial direction is longitudinal in the width direction.

Figure 3:
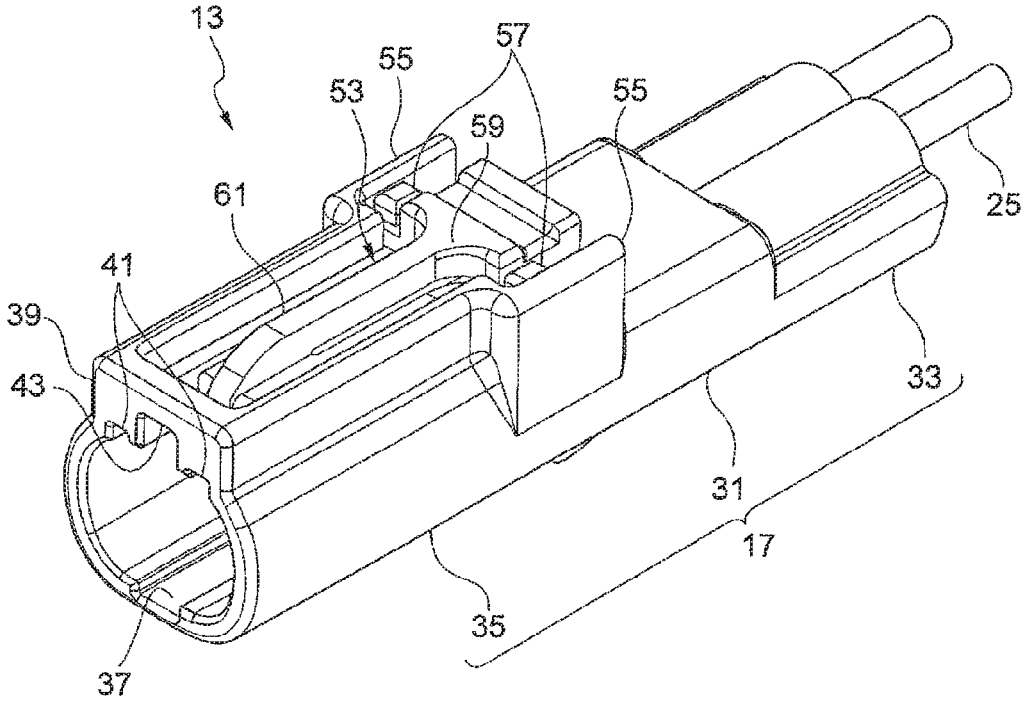
FIG. 3 is an appearance perspective view of a male connector.

As shown in FIG. 3, the inner wall of the hood part 35 is formed with a guiding groove 37 which extends axially. A wall 39 which rises into a board-like shape and which is flush with the front end surface of the hood part 35 is provided with a pair of first cut parts 41 and a second cut part 43 which is formed at the inner side of the pair of first cut parts 41.

Figure 4:
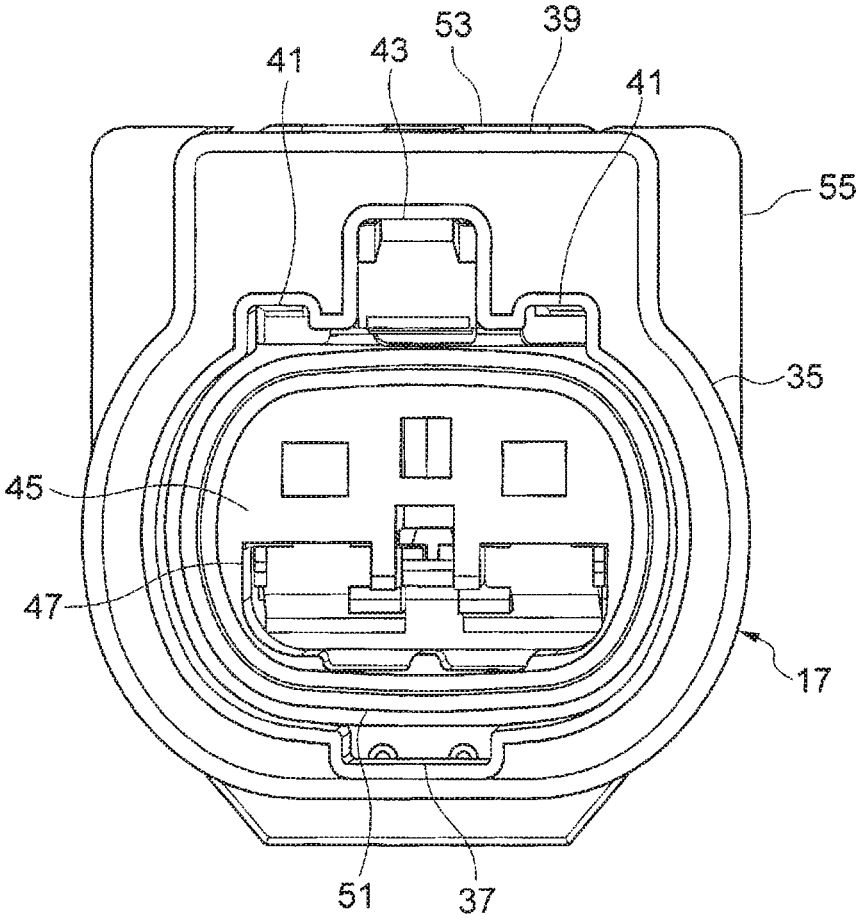
FIG. 4 is a front view of a male housing of the male connector of FIG. 3.

The male terminal accommodating room 29 accommodates the two male terminals 21 which are separated from each other by separating walls not illustrated, and maintains the male terminals 21 at set positions by making lances not illustrated which extends inside the male terminal accommodating room 29 engaged with the male terminals 21. As shown in FIGS. 4 and 6, the male terminal accommodating room 29 is formed by making an opening 47 which opens at a front end surface 45 of the base 31 surrounded by the hood part 35 communicate with a through hole 49 which penetrates through the electric wire holding part 33 axially. The inner side of the hood part 35 is provided with a cylindrical male side annular member 51 which projects forward to surround the opening 47 from the fringe of the opening 47 of the base 31.

As shown in FIG. 3, the male housing 17 has a locking arm 53 which extends forward axially along the outer surface into a cantilever shape. The locking arm 53 is formed to have two legs 57 which are respectively supported on a pair of walls 55 which rises upward from the two side surfaces in the width direction of the base 31, a base end 59 which links these legs 57 in the width direction, and an arm 61 which extends forward from the base end 59.

The front end of the arm 61 of the locking arm 53 is able to be displaced upward from a horizontal direction with the base end 59 as a fulcrum. As shown in FIG. 6, the lower part of the front end of the arm 61 is provided with a locking part 63 which projects downward. As shown in FIG. 3, the walls 55 surround the locking arm 53 and are provided from the base 31 of the male housing 17 toward the wall 39 of the hood part 35. The upper end surface of the locking arm 53 is set at the same height as or a height lower than those of the upper end surfaces of the walls 39, 55.

As shown in FIG. 1, the male terminal 21 is formed of a conductive metal plate or the like, and integrally includes an electric wire connecting part 65 which is crimped and connected to the core wire of the electric wire 25, and a male tab 67 which is connected to the female terminal 23. The male tab 67 is formed into a stick shape to extend forward/backward. While the male terminal 21 is maintained in the set position of the male terminal accommodating room 29, the male tab 67 projects from the front end surface 45 and extends forward beyond the front end of the male side annular member 51.

Figure 5:
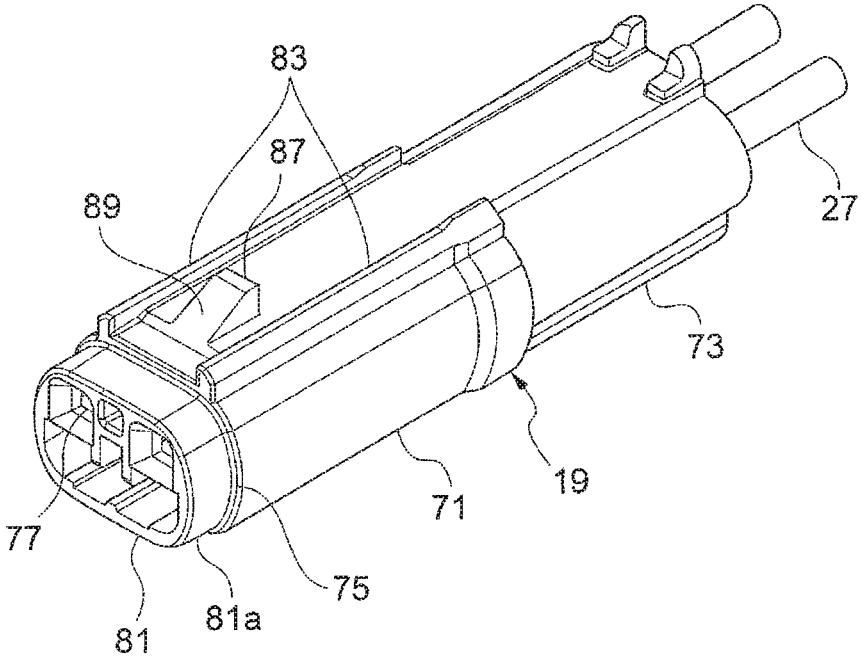
FIG. 5 is an appearance perspective view of the female connector.

On the other hand, as shown in FIG. 1, the female connector 15 has the female housing 19, which is formed of insulative synthetic resin into a cylindrical shape, and the female terminals 23 which are accommodated in the female housing 19 from the back side. As shown in FIGS. 5 and 6, the cross section, perpendicular to the axial direction, of the female housing 19 is formed into a shape substantially similar to the inner peripheral surface of the hood part 35 of the male housing 17, and the female housing 19 is formed by integrally including a base 71 in which two female terminal accommodating rooms 69 (cavities) into which the female terminals 23 are inserted are formed, and an electric wire holding part 73 which projects backward from the base 71. The female terminal accommodating rooms 69 are formed to separate the two female terminals 23 from each other by separating walls not illustrated, and maintain the female terminals 21 at set positions by making lances not illustrated which extends inside the female terminal accommodating rooms 69 engaged with the female terminals 23.

As shown in FIGS. 5 and 6, the female terminal accommodating room 69 is formed by making an opening 77 which opens at a front end surface 75 of the base 71 communicate with a through hole 79 which penetrates through the electric wire holding part 73 axially. The base 71 is provided with a cylindrical female side annular member 81 which projects forward from the front end surface 75 to surround the opening 77 from the fringe of the opening 77. The female side annular member 81 is formed to have an outer peripheral surface 81*a* which is reduced stepwise from the outer peripheral surface of the base 71.

The female housing 19 is provided with a pair of ridges 83 which extend axially from the top surface of the base 71 as shown in FIG. 5, and a step-like part 85 which extends axially from the bottom surface of the base 71 as shown in FIG. 6. The pair of ridges 83 are provided apart in the width direction, and become able to abut against the inner peripheral surface of the male housing 17, respectively. The inner side of the pair of ridges 83 is provided with a locking part 87 which projects upward. The locking part 87 is provided with an inclined surface 89 which is inclined downward toward the front side of the base 71, and when the two housings are fitted together, the locking arm 53 of the male housing 17 is pushed up along the inclined surface 89.

As shown in FIG. 1, the female terminal 23 is formed of a conductive metal plate or the like, and integrally includes an electric wire connecting part 91 which is crimped and connected to the core wire of the electric wire 27, and a rectangular tubular electrical contact part 93 which the male tab 67 of the male terminal 21 is inserted into and connected with. The electrical contact part 93 is provided with a distal end which is at a position flush with the opening 77 of the base 71 or backward only a predetermined distance from the opening 77, while the female terminal 23 is maintained at the set position of the female terminal accommodating room 69.

Figure 7:
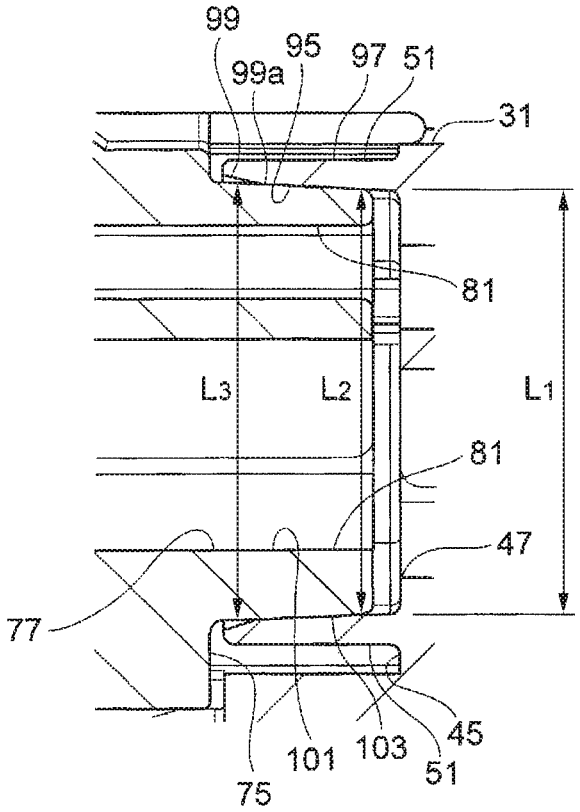
FIG. 7 is a partially enlarged view of FIG. 6.
Figure 8:
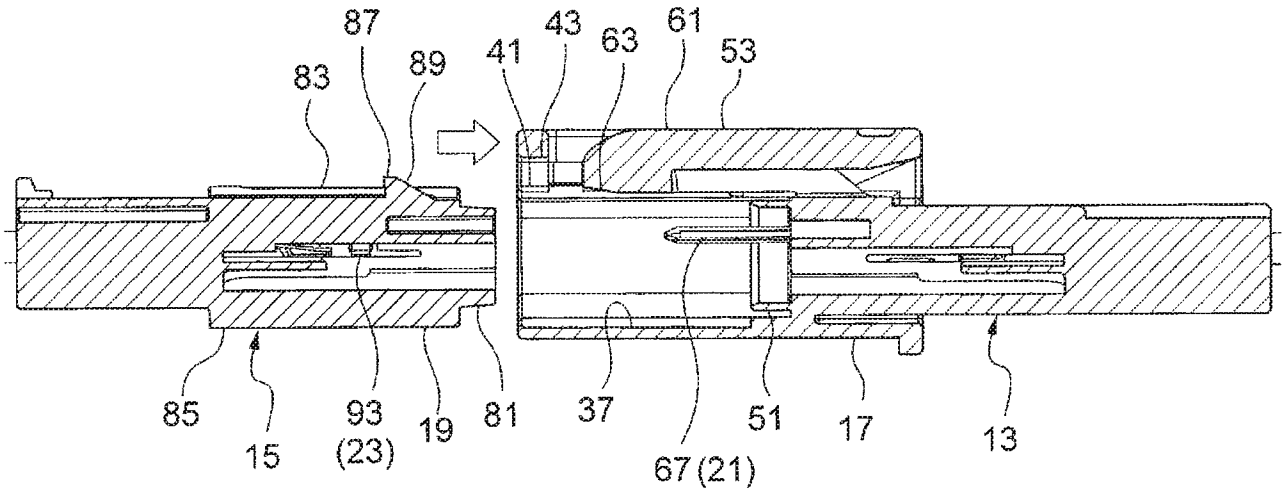
FIG. 8 is an illustration of movement before the male connector and the female connector are fitted together.

Then, the characteristic constitution of the present embodiment is described. In this embodiment, when the male housing 17 and the female housing 19 are fitted together, the female side annular member 81 is fitted into the inside of the male side annular member 51. FIG. 7 is an enlarged view in the frame of FIG. 6. The male side annular member 51 is extended into a cylindrical shape from the fringe of the opening 47 of the base 31 of the male housing 17, and is formed to have a relatively strong resilience in comparison with the female side annular member 81. The male side annular member 51 is formed into an oval cylindrical shape whose cross section perpendicular to the axial direction of the male housing 17 is longitudinal in the width direction, and has an inner peripheral surface 95 and an outer peripheral surface 97 which extend in parallel with the axis of the male housing 17. The thickness of the male side annular member 51 is set uniform axially. The inner peripheral surface of the male side annular member 51 at the distal end is formed with an inclined surface 99 which is inclined in the direction apart from the opposed female side annular member 81 and is widened forward to the end. The inclined surface 99 guides the female side annular member 81 into the inside of the male side annular member 51.

The female side annular member 81 is a member made of resin which is extended into a cylindrical shape from the fringe of the opening 77 of the base 71 of the female housing 19, and is formed to have a rigidity higher than that of the male side annular member 51. The female side annular member 81 has an inner peripheral surface 101 which is in parallel with the axis of the female housing 19, and an outer peripheral surface 103 which is formed into a shape to correspond to the inner peripheral surface 95 of the male side annular member 51 and which is obliquely formed to be widened to the end so that the thickness is gradually increased from the front end toward the back end. In this embodiment, the extent to which the female side annular member 81 projects axially from the front end surface 75 is set shorter than the extent to which the male side annular member 51 projects axially from the front end surface 45.

In this embodiment, when the inner dimensional size of the inner peripheral surface 95 in the height direction of the male side annular member 51 is assumed as L1, and the outer dimensional sizes of the front end and the back end of the outer peripheral surface 103 in the height direction of the female side annular member 81 are assumed as L2 and L3, respectively, L3 which is at least bigger than L2 is set bigger than L1, and specifically, there is a dimensional relation of $L2<L1<L3$. The dimensional relation is set over the entire peripheries of the male side annular member 51 and the female side annular member 81. Therefore, as the female side annular member 81 is inserted into the male side annular member 51, the inner peripheral surface 95 at the front end of the male side annular member 51 is pressed to the outer peripheral surface 103 of the female side annular member 81.

Then, an example of an assembling method and a fitting operation of the two housings is described. At first, as shown in FIG. 1, the male terminals 21 to which the electric wires 25 to which rubber stoppers 105 are mounted are connected are accommodated together with the rubber stoppers 105 in the male terminal accommodating room 29 of the male housing 17. Further, the female terminals 23 to which the electric wires 27 to which rubber stoppers 107 are mounted are connected are accommodated together with the rubber stoppers 107 in the female terminal accommodating rooms 69 of the female housing 19. In this state, as shown with the arrow of FIG. 8, the female housing 19 of the female connector 15 is inserted into the male housing 17 of the male connector 13.

When the female housing 19 is inserted into the male housing 17, the pair of ridges 83 of the female housing 19 pass the first cut parts 41 of the male housing 17, respectively, and the locking part 87 of the female housing 19 passes the second cut part 43 of the male housing 17. Further, the step-like part 85 of the female housing 19 is guided along the guiding groove 37 of the male housing 17.

Subsequently, when the insertion of the female housing 19 advances, the locking arm 53 of the male housing 17 is moved along the inclined surface 89 of the locking part 87 of the female housing 19 onto the locking part 87 and the arm 61 flexes upward. Then, after the locking part 63 of the arm 61 moves beyond the locking part 87, the arm 61 restores elastically. Thereby, the locking part 87 is locked to the locking part 63, and the two housings are locked in a regularly fitted state.

On the other hand, as shown in FIG. 7, the female side annular member 81 which is inserted into the male side annular member 51 is stopped while the inner peripheral surface of the male side annular member 51 is pressed over the entire periphery. By this pressing, the male side annular member 51 deforms elastically so that the distal end of the male side annular member 51 spread outward, but a restoring force due to this elastic deformation pushes the outer peripheral surface 103 of the female side annular member 81. Therefore, the front end of the male side annular member 51 and the back end of the female side annular member 81 become watertightly abutted against each other elastically over the entire periphery, and the gap between the opening 47 of the male connector 13 and the opening 77 of the female connector 15 is sealed. When the two housings are fitted together, the distal end surface of the male side annular member 51 becomes contactless to the female housing 19 side, and the distal end surface of the female side annular member 81 becomes contactless to the male housing 17 side.

Since the inner peripheral surface at the distal end of the male side annular member 51 is formed with the inclined surface 99, the inner peripheral surface of the male side annular member 51 is formed with a corner 99*a* at the back end of the inclined surface 99 over the entire periphery. Thereby, even if, for example, the male side annular member 51 and the female side annular member 81 are abutted against each other in an inclined state, because the corner 99*a* abuts against the outer peripheral surface of the female side annular member 81, the two annular members 51, 81 are abutted against each other surely over the entire periphery.

As described above, in the present embodiment, because when the male connector 13 and the female connector 15 are fitted together, the distal end of the male side annular member 51 which has resilience is pressed by the relatively rigid female side annular member 81 from the inner side to be pushed wide in an elastic range, the sealing property of the gap between the male side annular member 51 and the female side annular member 81 can be raised without making the male side annular member 51 and the female side annular member 81 deform plastically, and, as a result, water can be prevented from invading into the openings 47, 77 located at the inner sides of the male side annular member 51 and the female side annular member 81, and the waterproofness of the connector 11 can be improved. Further, because by making the female side annular member 81 directly contact the male side annular member 51 to be sealed, the rubber packing or the like to raise watertightness becomes unnecessary, the space inside the connector can be set small, and the connector 11 can be downsized and cost-reduced.

Because the male side annular member 51 is formed to have resilience (spring property), and is pressed to the female side annular member 81 over the entire periphery, excessive deformation is inhibited, and plastic deformation or damage of the connector 11 can be prevented. Furthermore, because even if the distance between the two annular members 51, 81 is changed by vibration transmitted to the connector 11, the male side annular member 51 can absorb the vibration by elastically deforming while maintaining a state of contacting the female side annular member 81, deterioration over time of the connector 11 associated with vibration can be inhibited.

In the present embodiment, when the female housing 19 is inserted into the male housing 17, the pair of ridges 83 is abutted against the inner peripheral surface of the male housing 17, respectively, and the step-like part 85 is guided along the guiding groove 37 of the male housing 17. Thereby, because a relative positional deviation of the male housing 17 and the female housing 19 is inhibited and the female side annular member 81 can be made contact the male side annular member 51 at the set position, the coherency of the two annular members 51, 81 can be raised and the waterproofness can be stabilized.

The embodiment of the present invention is described above in detail with reference to the figures, but the above embodiment is only an illustration of the present invention, and the present invention can be modified and changed in the range recorded in the claims.

For example, it is described in the present embodiment that when the male connector 13 and the female connector 15 are fitted together, the front end of the female side annular member 81 which is inserted into the male side annular member 51 is set contactless with the front end surface 45 of the male housing 17, and the front end of the male side annular member 51 is set contactless with the front end surface 75 of the female housing 19, but the distal end of either of the annular members may be formed to abut against the opposite housing (for example, the front end surfaces 45, 75). Accordingly, because the distal end of either of the annular members functions as a stopper by abutting against the opposite housing, relative movement of the male side annular member 51 and the female side annular member 81 is stopped, and damage due to excessive pushing of the annular members can be prevented. Further, because the contact areas of the two annular members can be increased, waterproofness can be raised.

It is described in the present embodiment that the female side annular member 81 presses the inner peripheral surface of the male side annular member 51 over the entire periphery, but instead it is also possible to construct so that the female side annular member 81 presses the outer peripheral surface of the male side annular member 51 over the entire periphery. In this case, the inner peripheral surface of the female side annular member 81 is formed with an inclined surface which is inclined to be widened to the end so that the thickness is gradually increased from the distal end toward the back. When the inner peripheral surface of the female side annular member 81 is formed in this way, because the outer peripheral surface 97 of the front end of the male side annular member 51 is pressed to the inclined inner peripheral surface 101 of the female side annular member 81 as the female side annular member 81 approaches, an effect like the present embodiment can be obtained. In this case, it is also desirable that the distal end inner peripheral surface of the female side annular member 81 is formed with an inclined surface corresponding to the above inclined surface 99.

Further, instead of that the inner peripheral surface or the outer peripheral surface of the female side annular member 81 is formed with the inclined surface, as described above, it is also possible that the inner peripheral surface or the outer peripheral surface of the male side annular member 51 is formed with an inclined surface. For example, the male side annular member 51 is formed so that the thickness is gradually increased from the distal end toward the back, and the distal end of the female side annular member 81 is formed to press the inclined surface of the male side annular member 51. Even if constructed in this way, an effect like the present embodiment can be obtained.

Second Embodiment

Then, the second embodiment that the present invention is applied to is described with reference to the figures. But the present embodiment is basically similar to the first embodiment. Therefore, in the following, only characteristic constitution of the present embodiment is described, and the description of those common constitutions to the first embodiment is omitted.

Figure 9:
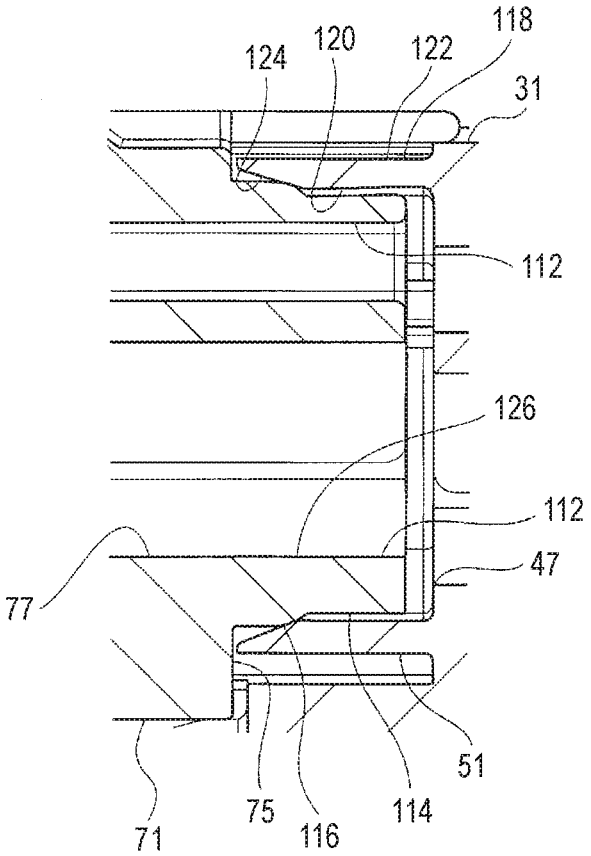
FIG. 9 is an enlarged view of main parts of a second embodiment.

FIG. 9 is an enlarged view of main parts of the present embodiment corresponding to FIG. 7. A connector waterproofing structure of the present embodiment differs from the connector waterproofing structure of the first embodiment in that, as shown in FIG. 9, an inner peripheral surface 120 of a male side annular member 118 is pressed to an inclined surface 116 which is formed in the middle from the front end (the distal end) of an outer peripheral surface 114 of a female side annular member 111 toward the back side (the inside). That is, while in the first embodiment, a gradual inclined surface which is continuous from the front end to the back end of the outer peripheral surface 103 of the female side annular member 81 is formed, in the present embodiment, the inclined surface 116 of a step-like shape is formed which suddenly rises up at an axial part of the outer peripheral surface 114.

The male side annular member 118 of the present embodiment is formed into an oval cylindrical shape whose cross section perpendicular to the axial direction of the male housing 17 is longitudinal in the width direction, and has the inner peripheral surface 120 which is pressed to the outer peripheral surface 114 of the female side annular member 111 when the male housing 17 and the female housing 19 are fitted together. The inner peripheral surface 120 of the male side annular member 118 is formed to extend in parallel with the axial direction of the male housing 17 like the outer peripheral surface 122 of the male side annular member 118, and has an inclined surface 124 which is inclined to be widened from the axial middle toward the front end.

The female side annular member 111 has a rigidity which is higher than that of the male side annular member 118. The female side annular member 111 has the outer peripheral surface 114 corresponding to the inner peripheral surface 120 of the male side annular member 118, and is formed with the annular inclined surface 116, whose thickness is gradually increased toward the back side, in the middle from the front end of the outer peripheral surface 114 toward the back side. That is, the female side annular member 111 is formed into a step-like shape axially through the inclined surface 116 over the entire periphery. As shown in FIG. 9, the inclined surface 116 is set to have an inclination angle which is bigger than the inclination angle (refer to FIG. 7) of the outer peripheral surface 103 of the female side annular member 81 of the first embodiment, and is formed at a position corresponding to the inclined surface 124 of the male side annular member 118 when the male housing 17 and the female housing 19 are fitted together. The inclined surface 116 and the inclined surface 124 are formed into a planar shape, respectively, but the cross section may be formed into an R-like shape.

According to the present embodiment, when the female side annular member 112 is inserted into the male side annular member 118, the inclined surface 124 of the male side annular member 118 is pressed over the entire periphery to the inclined surface 116 of the female side annular member 112. That is, the male side annular member 118 is pushed wide outward elastically because the inclined surface 124 is moved onto the inclined surface 116 of the female side annular member 112. In this case, because the inclined surface 116 suddenly rises from the middle from the front end of the female side annular member 112 toward the back side, and as a result, the region where the outer peripheral surface 113 of the female side annular member 112 contacts the inner peripheral surface 120 of the male side annular member 118 is limited, the pressing force per unit area by which the male side annular member 118 is pressed to the female side annular member 112 can be raised, and water can be surely prevented from invading into the openings 47, 77. In the present embodiment, like the first embodiment, the waterproofness of the connector 11 is improved by preventing plastic deformation of the connector 11, and the connector can be downsized.

Further, in the present embodiment, because the inclined surface 116 is formed in the middle from the front end of the female side annular member 112 toward the back side, friction does not produce between the female side annular member 112 and the male side annular member 118 until the male side annular member 118 abuts against the inclined surface 116. Therefore, when the male housing 17 and the female housing 19 are fitted together, insertion load to insert the female housing 19 into the male housing can be reduced, and assembling operativity of the connector 11 can be raised.

Further, because the male side annular member 118 of the present embodiment is formed to have the inclined surface 124 which abuts against the inclined surface 116 of the female side annular member 112, the inclined surface 124 is abutted against the inclined surface 116 pressing the inclined surface 116. Thereby, the male side annular member 118 can move smoothly along the inclined surface 116 even if the inclination angle of the inclined surface 116 is set big. Therefore, plastic deformation and damage at the time of the contact of the male side annular member 118 and the female side annular member 112 can be prevented, and insertion load when the male housing 17 is inserted into the female housing 19 can be reduced. If there is no trouble when the male side annular member 118 contacts the female side annular member 112, the inclined surface 124 of the male side annular member 118 also can be omitted.

It is described in this embodiment that, the female side annular member 112 presses the inner peripheral surface 120 of the male side annular member 118, but instead it is also possible to construct so that the female side annular member 112 presses the outer peripheral surface 122 of the male side annular member 118. In this case, the inner peripheral surface 126 of the female side annular member 112 is formed with the inclined surface 116 in the middle from the front end toward the back side. The inclined surface 116 can be formed at the inner peripheral surface 120 or the outer peripheral surface 122 of the male side annular member 118 instead of the female side annular member 112.

Third Embodiment

The third embodiment of a connector waterproofing structure which the present invention is applied to is described as follows with reference to FIGS. 10 to 17. In this embodiment, a waterproof connector loaded in an automobile, a motorcycle or the like is described as an example, but the waterproofing structure of the present invention can be applied to connectors besides this kind of connector.

Figure 10:
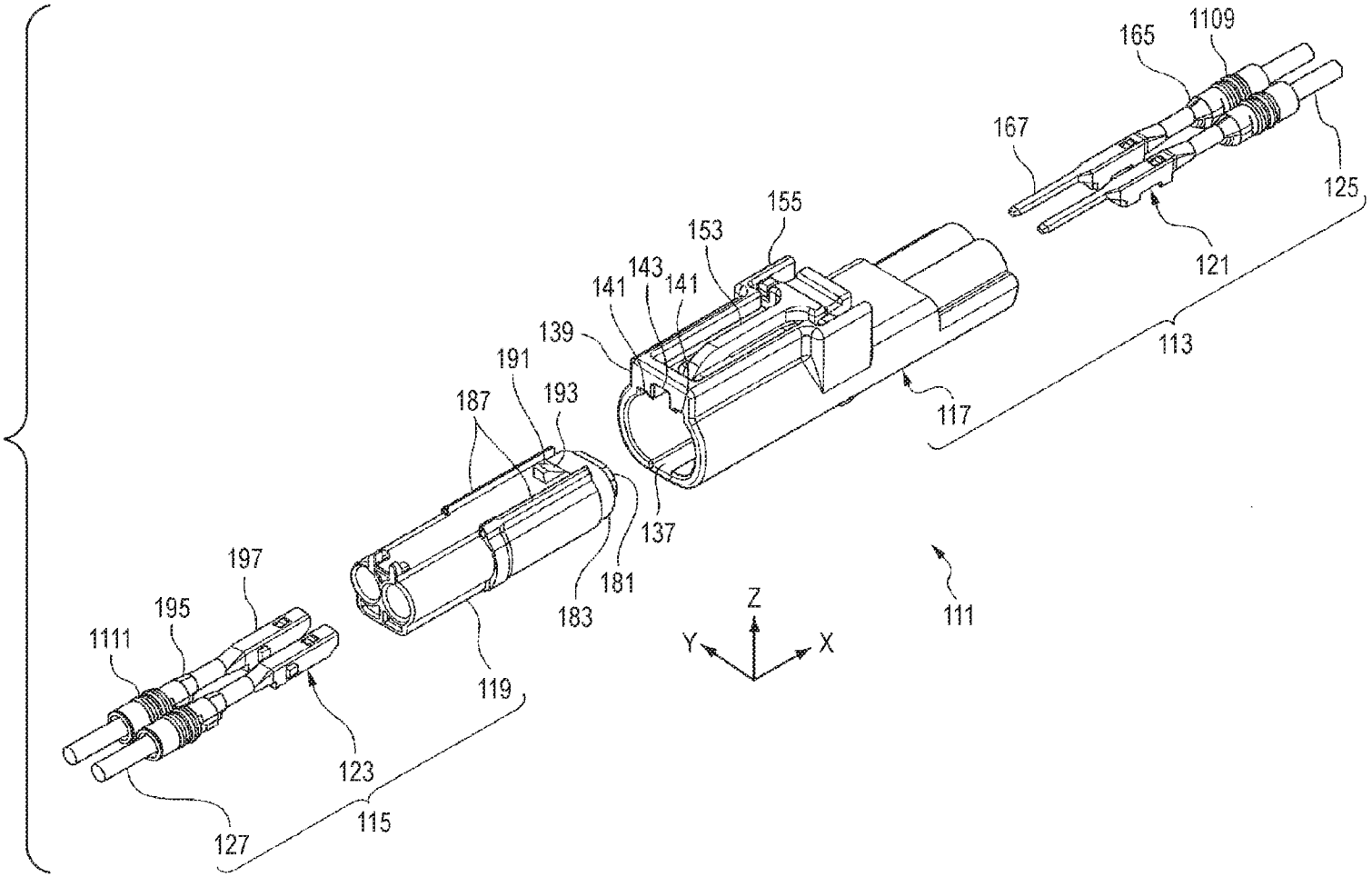
Figure 11:
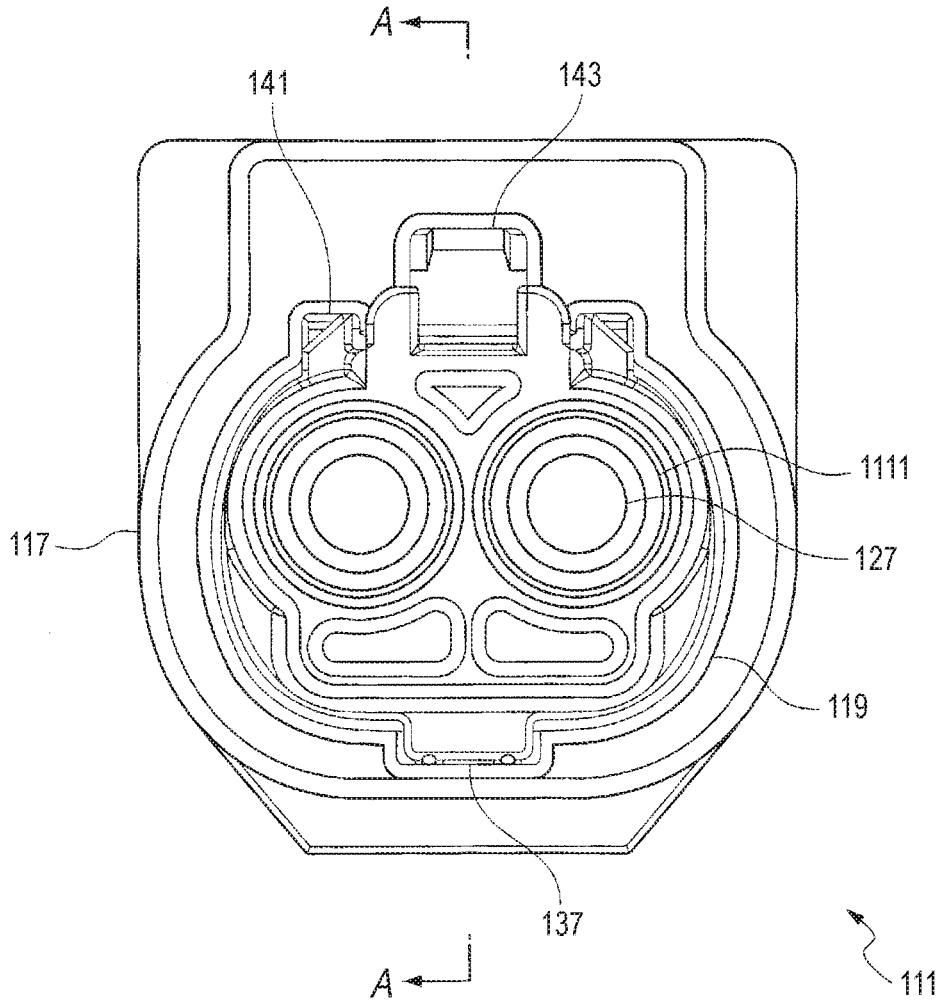
FIG. 11 is a figure of the connector of FIG. 10 when viewed from the back side of a female connector.

As shown in FIGS. 10 and 11, a connector 111 of the present embodiment includes a male connector 113 and a female connector 115, and when a male housing 117 of the male connector 113 and a female housing 119 of the female connector 115 are fitted together with each other, male terminals 121 which are accommodated in the male housing 117 and female terminals 123 which are accommodated in the female housing 119 are electrically connected. Electric wires 125 are connected to the male terminals 121, and electric wires 127 are connected to the female terminals 123. The female housing 119 is locked to the male housing 117 while one end side of the female housing 119 is fitted into the inside of the male housing 117. In this embodiment, an example in which two terminals are accommodated in each connector is described, but the number of the terminals which are accommodated is not limited to two. In the following description, in FIG. 10, the X direction is defined as a forward/backward direction, the Y direction as a width direction, the Z direction as a height direction, the fitting directions of the two connectors respectively as a forward direction, and the upper side of FIG. 10 as an upside.

Figure 12:
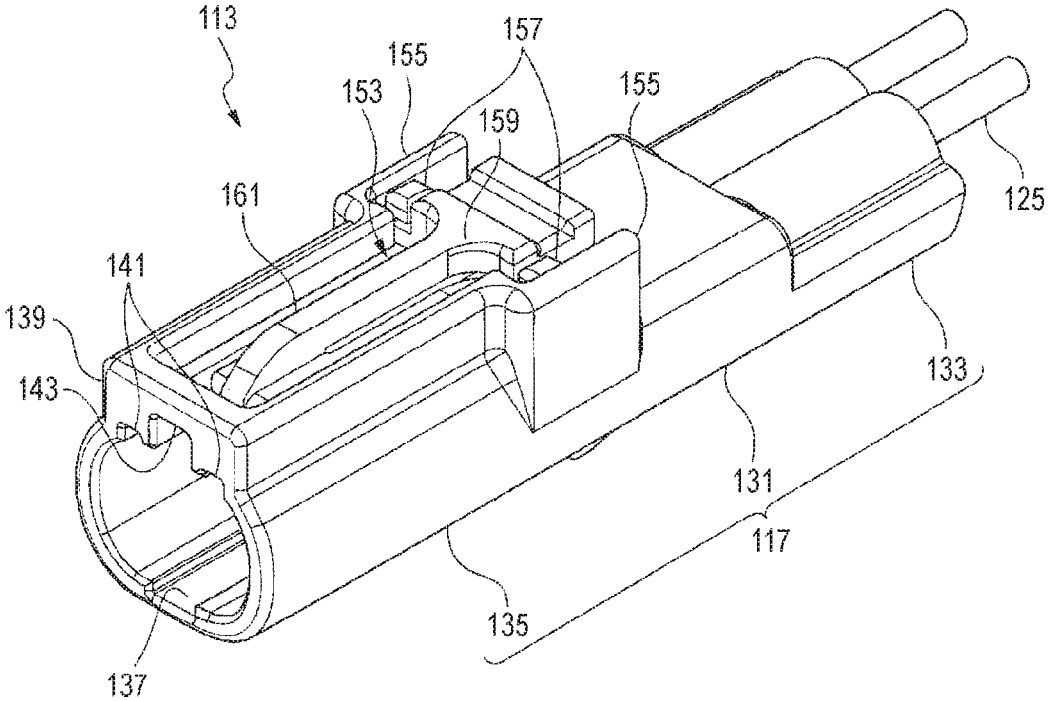
FIG. 12 is an appearance perspective view of a male connector.
Figure 13:
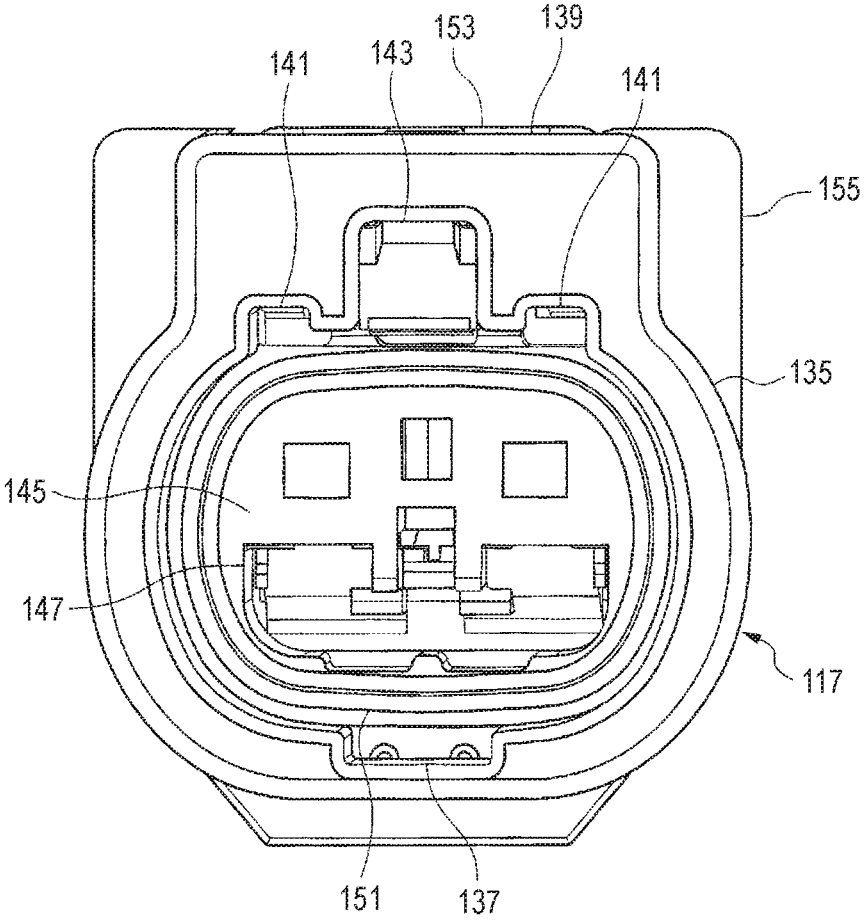
FIG. 13 is a front view of a male housing of the male connector of FIG. 12.
Figure 15:
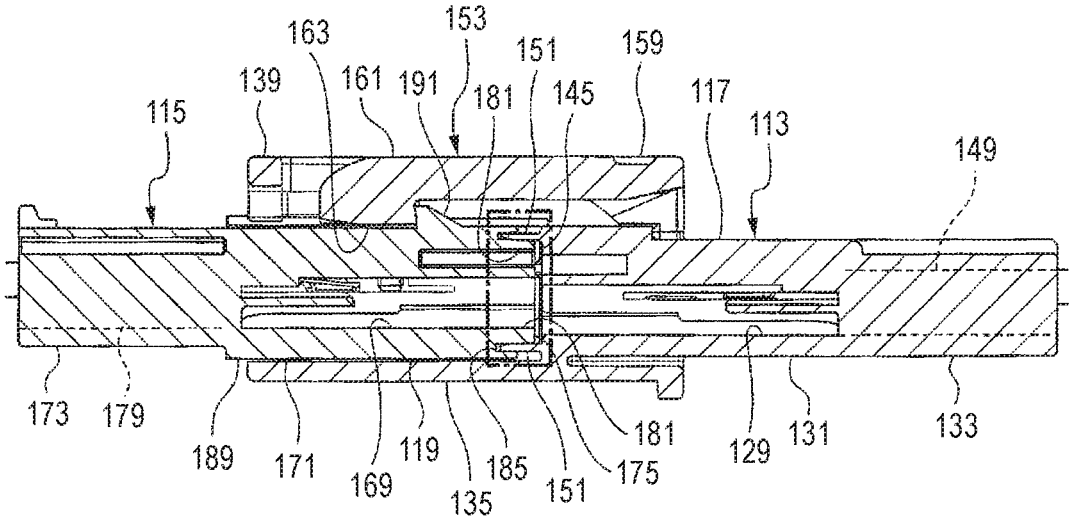
FIG. 15 is an A-A arrow sectional view of FIG. 11.

As shown in FIGS. 10 and 12, the male connector 113 has the male housing 117, which is formed of insulative synthetic resin into a cylindrical shape, and the male terminals 121, which are accommodated in the male housing 117 from the back side. As shown in FIG. 15, the male housing 117 is formed by integrally including a tubular base 131 in which a male terminal accommodating room 129 (cavity), in which the male terminals 121 are accommodated, is formed, an electric wire holding part 133 which projects backward from the base 131, and a hood part 135 which projects forward from the base 131. The hood part 135 is formed to have a peripheral wall which extends from the peripheral wall of the base 131, and is formed into a cylindrical shape whose cross section perpendicular to the axial direction is oval.

As shown in FIG. 12, the inner surface of the hood part 135 is formed with a guiding groove 137 which extends axially. A wall 139 which rises into a board-like shape and which is flush with the front end surface of the hood part 135 is provided with a pair of first cut parts 141 and a second cut part 143 which is formed at the inner side of the pair of first cut parts 141.

Figure 14:
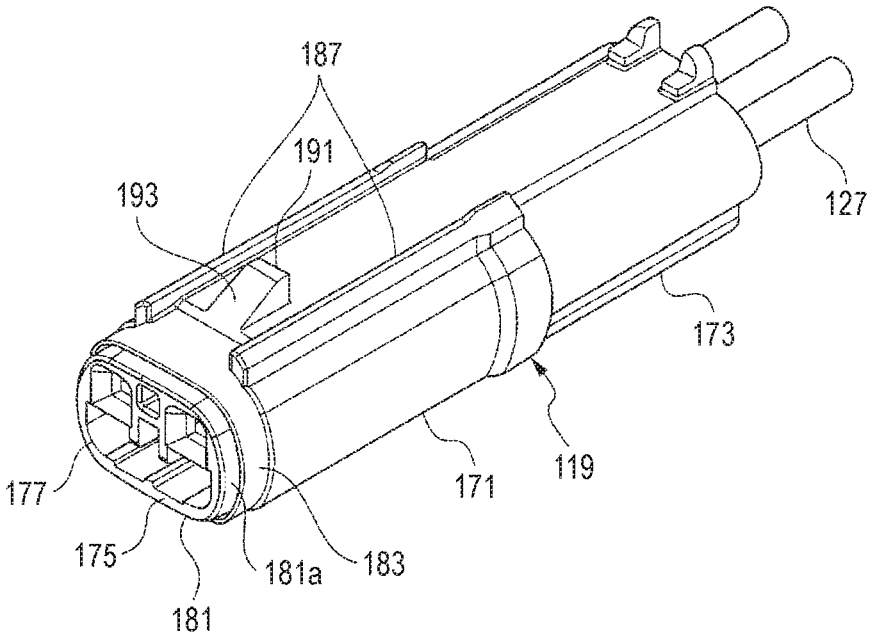
FIG. 14 is an appearance perspective view of the female connector.

The male terminal accommodating room 129 accommodates the two male terminals 125 which are separated from each other by separating walls not illustrated, and maintains the male terminals 125 at set positions by making lances not illustrated which extends inside the male terminal accommodating room 129 engaged with the male terminals 21. As shown in FIGS. 14 and 15, the male terminal accommodating room 129 is formed by making an opening end 147 which opens at a front end surface 145 of the base 131 surrounded by the hood part 135 communicate axially with a through hole 149 which penetrates through the electric wire holding part 133 axially. The inner side of the hood part 135 is provided with a cylindrical outside annular part 151 which extends forward from the front end surface 145 of the fringe of the opening end 147 of the base 131.

As shown in FIG. 12, the male housing 117 has a locking arm 153 which extends forward axially along the outer surfaces of the base 131 and the hood part 135 into a cantilever shape. The locking arm 153 is formed to have two legs 157 which are respectively supported on a pair of walls 155 which rises upward from the two side surfaces in the width direction of the base 131, a base end 159 which links these legs 157 to be supported, and an arm 161 which extends forward from the base end 159.

The front end of the arm 161 of the locking arm 153 is able to be displaced upward from a horizontal direction with the base end 159 supported on the walls 155 as a fulcrum. As shown in FIG. 15, the lower part of the front end of the arm 161 is provided with a locking part 163 which projects downward. As shown in FIG. 12, the walls 155 link the wall 139 of the hood part 135 to surround the locking arm 153 and are formed to rise to a frame shape. The region around the locking arm 153 formed by being surrounded by the walls 139, 155 is opened to face the inside (for example, the outside annular part 151 or the like) from the outside of the male housing 117. The upper end surface of the locking arm 153 is set at the same height as or a height lower than those of the upper end surfaces of the walls 139,155.

As shown in FIG. 10, the male terminal 121 is formed of a conductive metal plate or the like, and integrally includes an electric wire connecting part 165 which is crimped and connected to the core wire of the electric wire 125, and a male tab 167 which is connected to the female terminal 123. The male tab 167 is formed into a stick shape to extend forward/backward. While the male terminal 121 is maintained in the set position of the male terminal accommodating room 129, the male tab 167 projects from the opening end 147 and extends forward beyond the front end of the outside annular part 151.

On the other hand, as shown in FIG. 10, the female connector 115 has the female housing 119, which is formed of insulative synthetic resin into a cylindrical shape, and the female terminals 123 which are accommodated in the female housing 119 from the back side. As shown in FIGS. 14 and 15, the cross section, perpendicular to the axial direction, of the female housing 119 is formed into a shape substantially similar to the hood part 135 of the male housing 117, and the female housing 19 is formed by integrally including a base 171 in which two female terminal accommodating rooms 169 (cavities) into which the female terminals 123 are inserted are formed, and an electric wire holding part 173 which projects backward from the base 171. The female terminal accommodating rooms 169 are formed to separate the two female terminals 123 from each other by separating walls not illustrated, and maintain the female terminals 21 at set positions by making lances not illustrated which extends inside the female terminal accommodating rooms 169 engaged with the female terminals 123.

As shown in FIGS. 14 and 15, the female terminal accommodating room 169 is formed by making an opening end 177 which opens at a front end surface 175 of the base 171 communicate axially with a through hole 179 which penetrates through the electric wire holding part 173 axially. The opening end 177 of the female terminal accommodating room 169 is located at the end surface of the inside annular part 181 which is located at the front end of the base 171, and the end surface of the inside annular part 181 becomes the front end surface 175 of the base 171. The inside annular part 181 has an outer peripheral surface 181*a* which is reduced stepwise from the outer peripheral surface of the base 171 at the back side of the inside annular part 181.

A part of the outer peripheral surface 181*a* of the inside annular part 181 is surrounded by an annular cover body 183 which extends forward along the outer peripheral surface of the base 171. The cover body 183 is provided along the outer peripheral surface 181*a* of the inside annular part 181 to be opposed to the outer peripheral surface 181*a*, and the front end surface of the cover body 183 is located behind the front end surface 175 of the inside annular part 181. When viewed from the front side of the female housing 119, an inner peripheral surface 186 of the cover body 183 and the outer peripheral surface 181*a* of the inside annular part 181 form a bottomed annular groove 185 which surrounds the opening end 177. That is, the inner peripheral surface 186 of the cover body 183 and the outer peripheral surface 181*a* of the inside annular part 181 become groove side surfaces, which are opposed to each other, of the annular groove 185, respectively, and these groove side surfaces determine a groove width so that the outside annular part 151 can be inserted.

The female housing 119 is provided with a pair of ridges 187 which extend axially from the top surface of the base 171 as shown in FIG. 14, and a step-like part 189 which extends axially from the bottom surface of the base 171 as shown in FIG. 15. The pair of ridges 187 are provided apart in the width direction, and become able to abut against the inner peripheral surface of the male housing 117, respectively. The inner side of the pair of ridges 187 is provided with a locking part 191 which projects upward. The locking part 191 is provided with an inclined surface 193 which is inclined downward toward the front side of the base 171, and when the two housings are fitted together, the locking arm 153 of the male housing 117 is pushed up along the inclined surface 193.

As shown in FIG. 10, the female terminal 123 is formed of a conductive metal plate or the like, and integrally includes an electric wire connecting part 195 which is crimped and connected to the core wire of the electric wire 127, and a rectangular tubular electrical contact part 197 which the male tab 167 of the male terminal 121 is inserted into and connected with. The electrical contact part 197 is provided with a distal end which is at a position backward only a predetermined distance from the opening end 177 of the base 171, while the female terminal 123 is maintained at the set position of the female terminal accommodating room 169.

Figure 16:
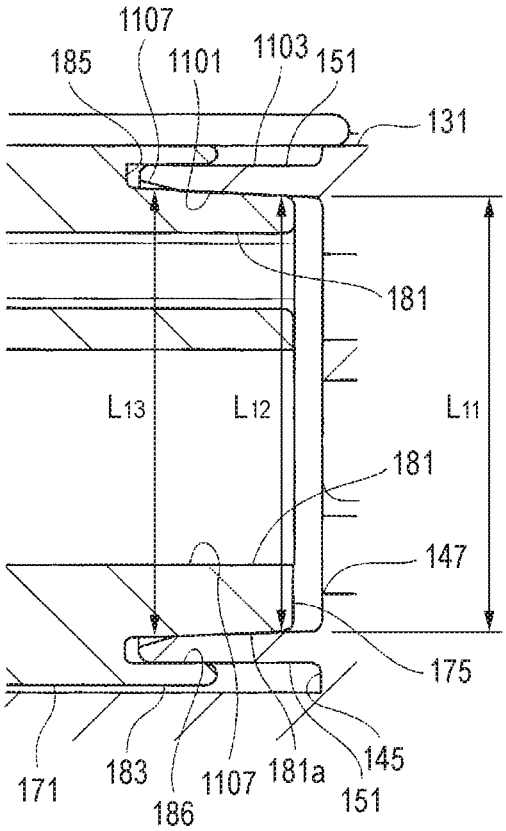
FIG. 16 is a partially enlarged view of FIG. 15.
Figure 17:
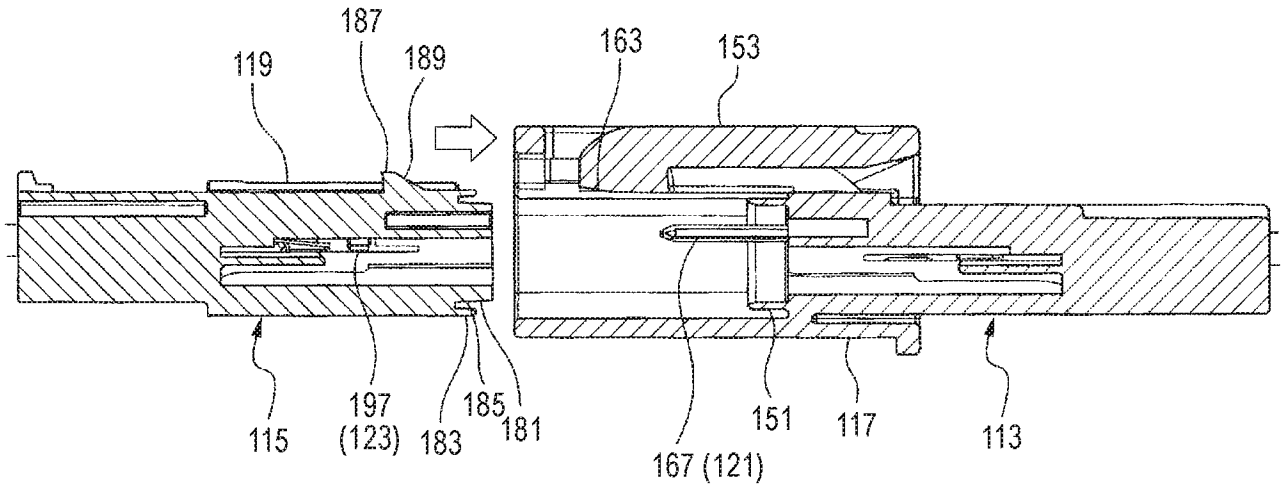
FIG. 17 is an illustration of movement before the male connector and the female connector are fitted together.

Then, the characteristic constitution of the present embodiment is described in detail. The connector 111 of the present embodiment, as shown in FIGS. 15 and 16, is provided with a watertight sealing part in which a gap between the opening ends of the male housing 117 and the female housing 119 is watertightly sealed by making the outside annular part 151 which is formed at the opening end of the male housing 117 fit together with (contact) the inside annular part 181 which is formed at the opening end of the female housing 119, and when the two housings are fitted together, the distal end (front end) of the outside annular part 151 is inserted into the annular groove 185 of the female housing 119 which is formed along the outer peripheral surface 181*a* of the inside annular part 181.

The outside annular part 151 is a member made of resin which extends into a cylindrical shape from the fringe of the opening end 147 of the male housing 117. The outside annular part 151 is fitted into the outside of the inside annular part 181 and is formed to have relatively strong resilience in comparison with the inside annular part 181. FIG. 16 is an enlarged view of sealing structure of the watertight sealing part (frame of FIG. 15) in which the outside annular part 151 which is fitted to the outer peripheral surface of the inside annular part 181 elastically deforms by being pushed wide outward.

The outside annular part 151 has an inner peripheral surface 1101 and an outer peripheral surface 1103 which extend in parallel with the axis of the male housing 117, and has a wall thickness which is set substantially uniform axially, but the inner peripheral surface 1101 at the distal end is formed with a chamfering part 1105 which is widened forward to the end.

The inside annular part 181 is a member made of resin which becomes the front end of the base 71 of the female housing 119 to be formed into an annular shape. The inside annular part 181 is outward-fitted with the outside annular part 181 and is formed to have a wall thickness bigger than that of the outside annular part 151 and a rigidity higher than that of the outside annular part 151. The inside annular part 181 is set to have an inner peripheral surface 1107 that is in parallel with the axis of the female housing 119 and an outer peripheral surface 181*a* which is inclined to be widened toward the back side (back) along the axial direction so that the wall thickness is gradually increased from the front end toward the back side.

In this embodiment, as shown in FIG. 16, when the inner dimensional size of the inner peripheral surface 1101 in the height direction of the outside annular part 151 is assumed as L11, and the outer dimensional sizes of the front end and the back end of the outer peripheral surface 181*a* in the height direction of the inside annular part 181 are assumed as L12 and L13, respectively, L13 which is at least bigger than L12 is set bigger than L11, and specifically, there is a dimensional relation of L12<L11<L13. The dimensional relation is set over the entire peripheries of the outside annular part 151 and the inside annular part 181. Therefore, as the distal end of the outside annular part 151 is inserted into the annular groove 185 of the female housing 119, the inner peripheral surface 1101 of the distal end of the outside annular part 151 is adhered to the outer peripheral surface 181*a* of the inside annular part 181 in a way of just being pressed to be pushed wide, and the gap between the opening ends of the male housing 117 and the female housing 119 is watertightly sealed.

The distal end of the outside annular part 151, whose distal end is inserted into the annular groove 185, is covered with the cover body 183. In this embodiment, since the distal end of the outside annular part 151 is pushed wide outward by the inside annular part 181, the outer peripheral surface 1103 of the distal end is abutted against the inner peripheral surface 186 of the cover body 183.

Then, an example of fitting operation of the two housings is described. At first, as shown in FIG. 10, the male terminals 121 to which the electric wires 125 to which rubber stoppers 1109 are mounted are connected are accommodated together with the rubber stoppers 1109 in the male terminal accommodating room 129 of the male housing 117. Further, the female terminals 123 to which the electric wires 127 to which rubber stoppers 1111 are mounted are connected are accommodated together with the rubber stoppers 1111 in the female terminal accommodating rooms 169 of the female housing 119. In this state, as shown with the arrow of FIG. 17, the female housing 119 and the male housing 117 is brought close to each other.

When the female housing 119 is inserted into the hood part 135 of the male housing 117, the pair of ridges 187 of the female housing 119 pass the first cut parts 141 of the male housing 117, respectively, and the locking part 191 of the female housing 119 passes the second cut part 143 of the male housing 117. Further, the step-like part 189 of the female housing 119 is guided along the guiding groove 137 of the male housing 117.

When the insertion of the female housing 119 advances, the locking arm 153 of the male housing 117 is moved along the inclined surface 193 of the locking part 191 of the female housing 119 onto the locking part 191, and the arm 161 flexes upward. Then, after the locking part 163 of the arm 161 moves beyond the locking part 191, the arm 161 restores elastically. Thereby, the locking part 191 is locked to the locking part 163, and the two housings are locked in a regularly fitted state.

Along with this, as shown in FIG. 16, the distal end of the outside annular part 151 which is fitted together with the inside annular part 181 is accommodated in the annular groove 185. For the distal end accommodated in the annular groove 185, the inner peripheral surface 1101 is pushed axially and abuts over the entire periphery against the inclined outer peripheral surface 181*a* of the inside annular part 181. At this time, the outside annular part 151 is pushed against the inside annular part 181 and deforms elastically to spread outward, but because the restoring force of this elastic deformation pushes the outer peripheral surface 181*a* of the inside annular part 181, the outside annular part 151 and the inside annular part 181 are adhered to each other over the entire periphery, and the gap between the opening end 147 of the male connector 113 and opening end 177 of the female connector 115 is watertightly sealed. Further, because the distal end of the outside annular part 151 is pushed wide outward, the outer peripheral surface 1103 abuts against the inner peripheral surface 186 of the cover body 183.

As described above, according to the present embodiment, when the male connector 113 and the female connector 115 are fitted together, the distal end of the outside annular part 151 of the male connector 113 is accommodated in the annular groove 185 of the female connector 115, and is covered with the cover body 183. Thereby, even if, for example, when the vehicle is washed, high pressure liquid for washing which is blown against the connector 111 is blown against the outside annular part 151 in the connector 111 through the opening around the locking arm 153, because it can be prevented that the high pressure liquid contacts the distal end of the outside annular part 151 which abuts against the inside annular part 181, a watertight state of the outside annular part 151 and the inside annular part 181 can be maintained, and a waterproofness drop of the connector 111 can be inhibited.

In the present embodiment, because the distal end of the outside annular member 151 abuts against the inner peripheral surface 186 of the cover body 183, the distal end of the outside annular member 151 is caught by the pair of opposed groove side surfaces of the annular groove 185, that is, the outer peripheral surface 181*a* of the inside annular part 181 and the inner peripheral surface 186 of the cover body 183, and is maintained in the annular groove 185. Therefore, even if the high pressure liquid contacts a part exposed from the annular groove 185 of the outside annular part 151, because a contact state with the inside annular part 181 can be stably maintained, a waterproofness drop of the connector 111 can be prevented more surely.

In the present embodiment, because the cover body 183 is formed along the outer peripheral surface of the female housing 119, the connector 111 is not upsized and it is possible to simplify the structure. Therefore, the production cost can be maintained low.

In the present embodiment, because the outside annular part 151 and the inside annular part 181 are formed of resin respectively, and the sealing is realized by making the outside annular part 151 and the inside annular part 181 contact, a rubber packing for waterproofing or the like becomes unnecessary. Therefore, deterioration of the rubber packing, damage caused by high water pressure or the like can be prevented, and the waterproofness of the connector 111 can be maintained high. In addition, because the space where the rubber packing is provided becomes unnecessary, the connector 111 can be downsized.

Because the outside annular part 151 has resilience (spring property), and is formed to press the inside annular part 181 over the entire periphery, even if, for example, vibration is transmitted to the connector 111, and the two annular members 151, 181 vibrate axially, the outside annular part 151 elastically deforms to absorb the vibration while maintaining a state of contacting the inside annular part 181. Therefore, a backlash between the housings will not occur, and deterioration over time of the connector 111 with the vibration can be inhibited.

The embodiment of the present invention is described above in detail with reference to the figures, but the above embodiment is only an illustration of the present invention, and the present invention can be modified and changed in the range recorded in the claims.

For example, it is described in the present embodiment that, the cover body 183 of the female housing 119 is formed to extend annularly along the outer peripheral surface of the base 171, but it is also possible that the cover body 183 is provided to at least cover the outer peripheral surface 1103 of the distal end of the outside annular part 151 that is easy to be affected by high pressure liquid when the two housings are fitted together, and for example, the cover body 183 may be formed into an arc form of part of a ring.

It is described in the present embodiment that, the male housing 117 is formed with the outside annular member 151 and the female housing 119 is formed with the inside annular member 181 and the cover body 183, but the present invention is not limited to this example, and it is also possible that the male housing 117 is formed with the inside annular member 181 and the cover body 183 and the female housing 119 is formed with the outside annular member 151.

In the watertight sealing part of the present embodiment, a mutual contact state is maintained by using elastic deformation when the outside annular part 151 and the inside annular part 181 are fitted together, but for the structure that watertightly seals the gap between the opening ends of the two housings, each annular member does not necessarily have to elastically deform. For example, it is also possible to make the inclined surfaces of the outside annular part 151 and the inside annular part 181 having rigidity contact each other watertightly, and it is also possible to make the distal end surface of the outside annular member 151 contact the groove bottom of the annular groove 185 watertightly.

Fourth Embodiment

The fourth embodiment of a connector waterproofing structure which the present invention is applied to is described as follows with reference to FIGS. 18 to 25. In this embodiment, a waterproof connector loaded in an automobile, a motorcycle or the like is described as an example, but the waterproofing structure of the present invention can be applied to connectors besides this kind of connector.

Figure 18:
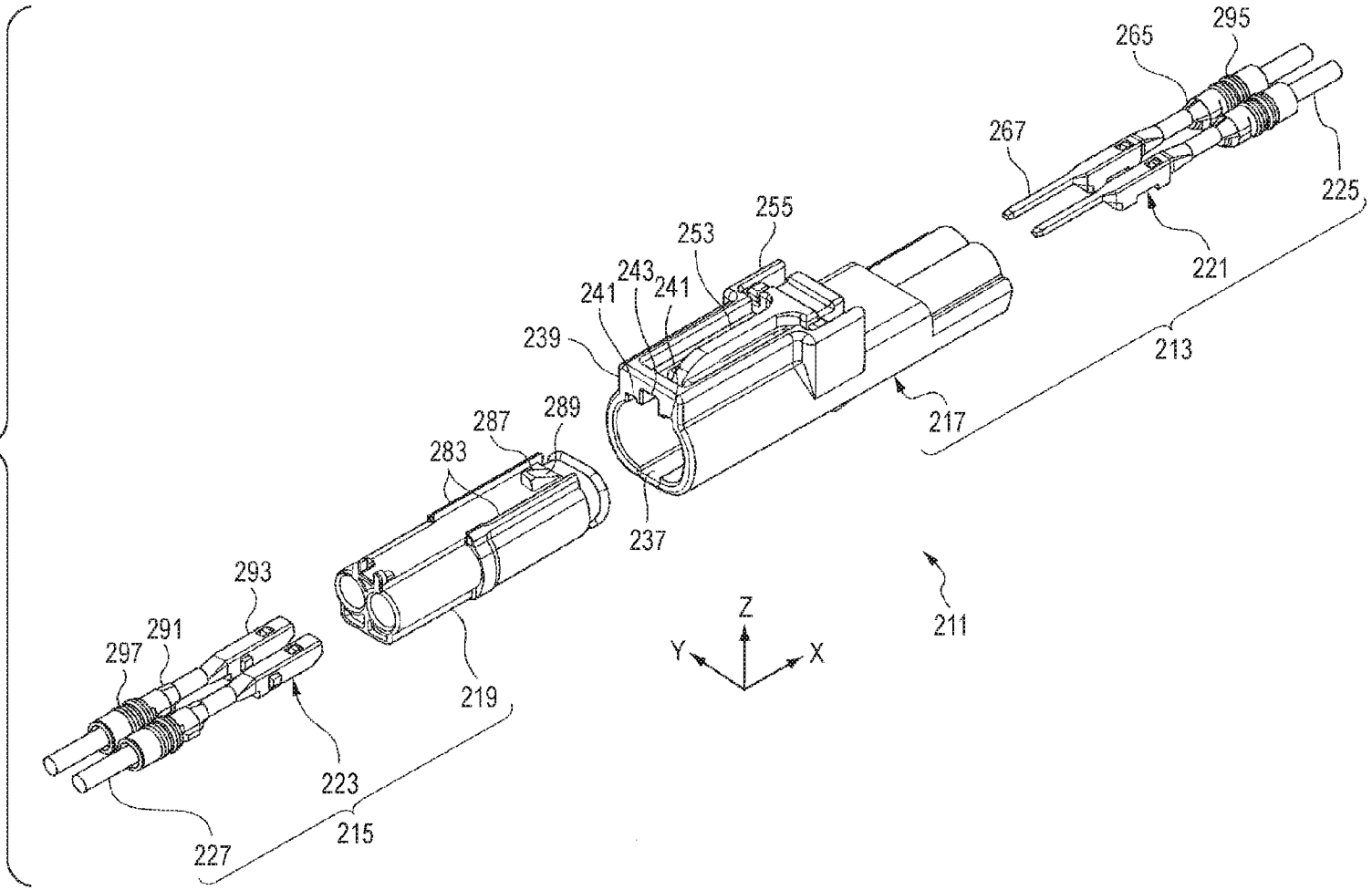
FIG. 18 is an exploded perspective view of a connector of an embodiment of the present invention.
Figure 19:
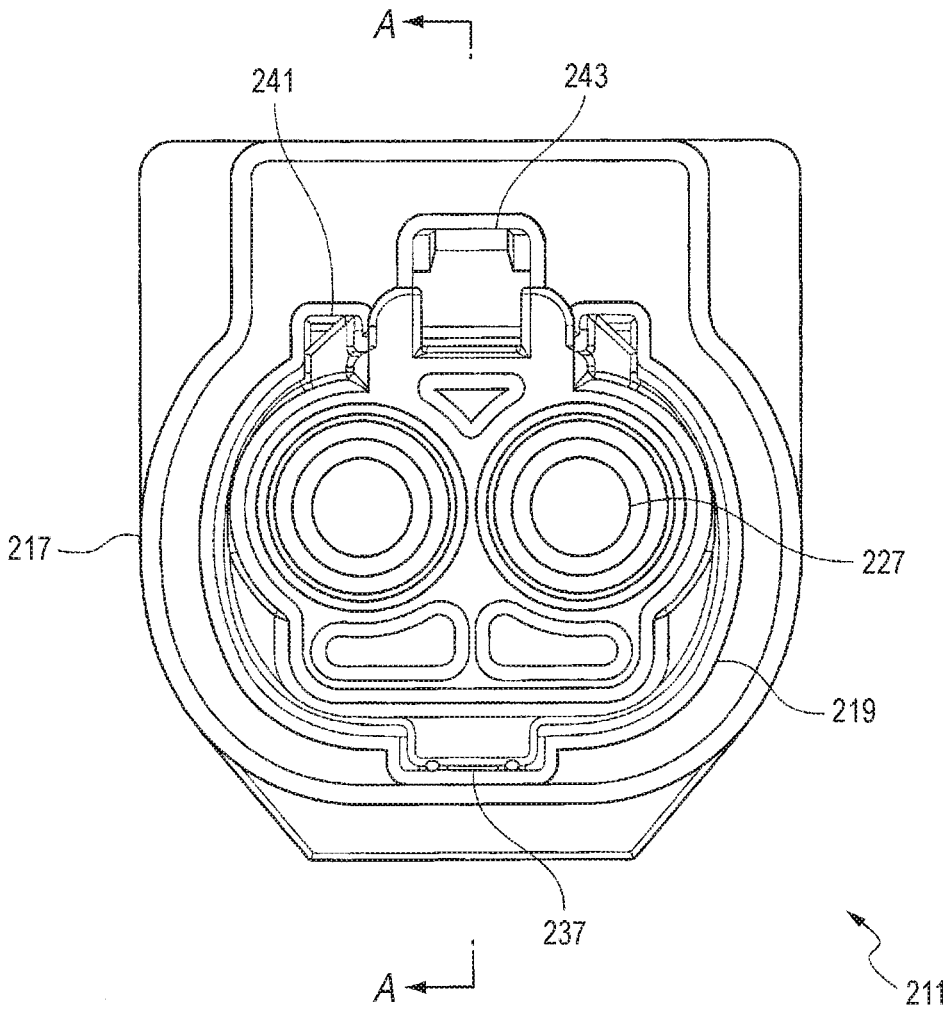
FIG. 19 is a figure of the connector of FIG. 18 when viewed from the back side of a female connector.

As shown in FIGS. 18 and 19, a connector 211 of the present embodiment includes a male connector 213 and a female connector 215, and when a male housing 217 of the male connector 213 and a female housing 219 of the female connector 215 are fitted together (engaged) with each other, male terminals 221 which are accommodated in the male housing 217 and female terminals 223 which are accommodated in the female housing 219 are electrically connected. Electric wires 225 are connected to the male terminals 221, and electric wires 227 are connected to the female terminals 223. The female housing 219 is locked to the male housing 217 while one end side of the female housing 219 is fitted into the inside of the male housing 217. In this embodiment, an example in which two terminals are accommodated in each connector is described, but the number of the terminals which are accommodated is not limited to two. In the following description, in FIG. 18, the X direction is defined as a forward/backward direction, the Y direction as a width direction, the Z direction as a height direction, the fitting directions of the two connectors respectively as a forward direction, and the upper side of FIG. 10 as an upside.

Figure 20:
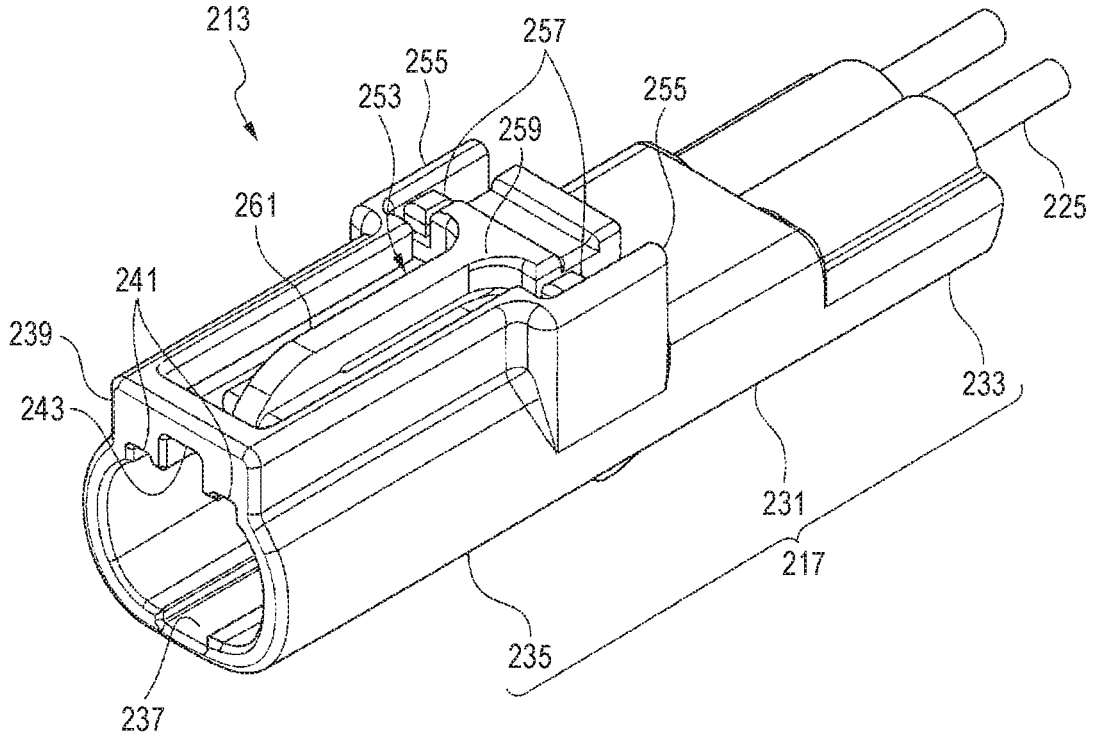
FIG. 20 is an appearance perspective view of a male connector.
Figure 23:
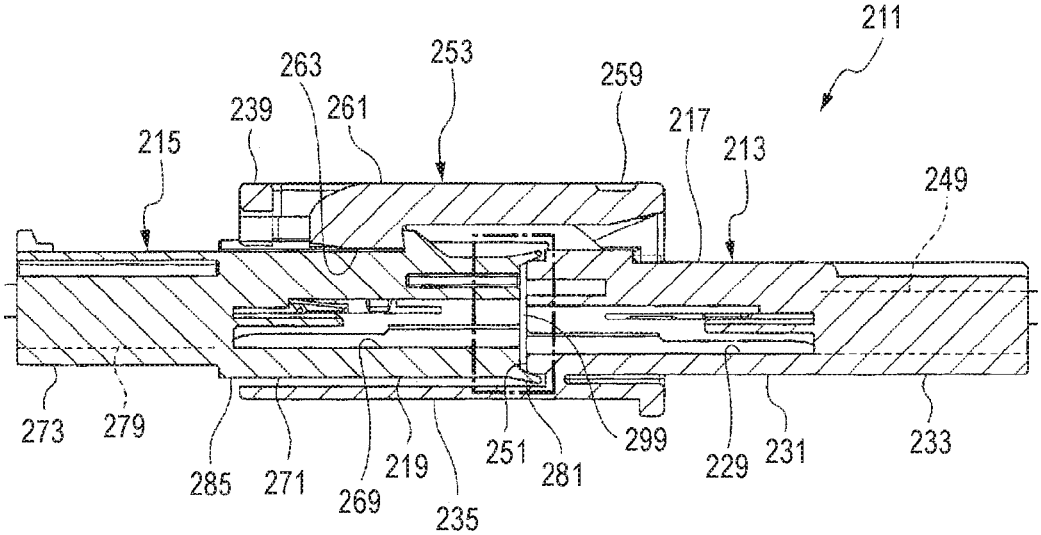
FIG. 23 is an A-A arrow sectional view of FIG. 19.

As shown in FIGS. 18 and 20, the male connector 213 has the male housing 217, which is formed of insulative synthetic resin into a cylindrical shape, and the male terminals 221, which are accommodated in the male housing 217 from the back side. As shown in FIG. 23, the male housing 217 is formed by integrally including a tubular base 231 in which a male terminal accommodating room 229 (cavity), in which the male terminals 221 are accommodated, is formed, an electric wire holding part 233 which projects backward from the base 231, and a hood part 235 which projects forward along the outer peripheral surface of the base 231. The cross section perpendicular to the axial direction of the hood part 235 is formed into an oval cylindrical shape.

As shown in FIG. 20, the inner surface of the hood part 235 is formed with a guiding groove 237 which extends axially. A wall 239 which rises up into a board-like shape and which is flush with the front end surface of the hood part 235 is provided with a pair of first cut parts 241 and a second cut part 243 which is formed at the inner side of the pair of first cut parts 241.

Figure 21:
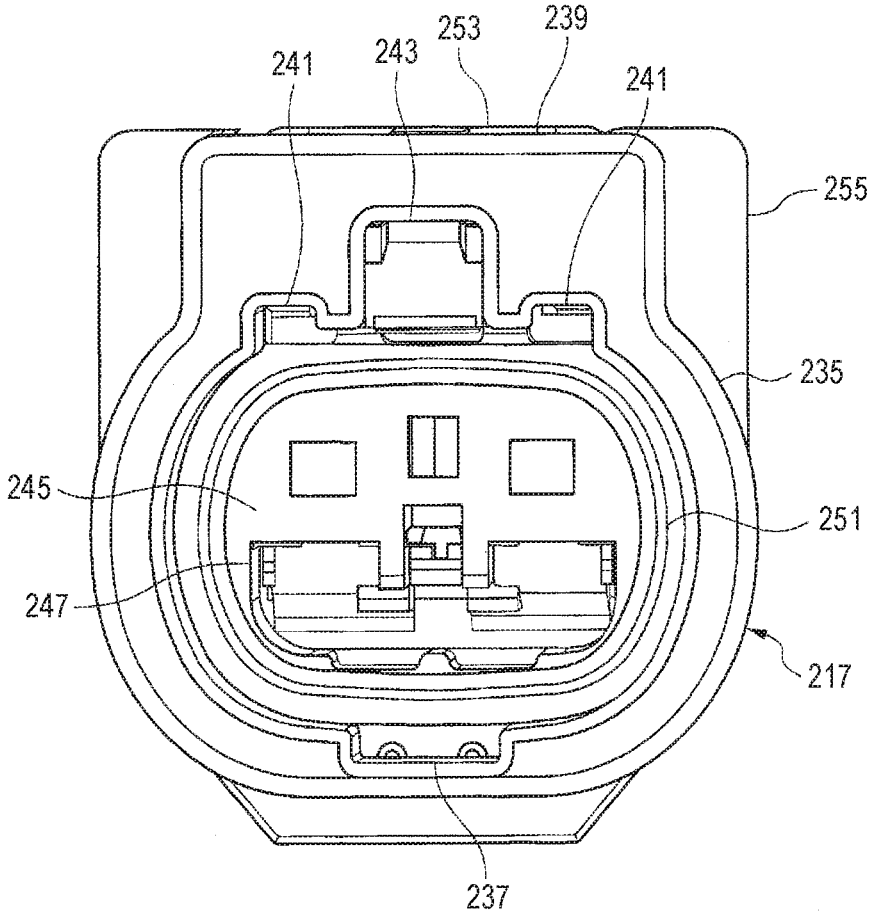
FIG. 21 is a front view of a male housing of the male connector of FIG. 20.

The male terminal accommodating room 229 accommodates the two male terminals 225 which are separated from each other by separating walls not illustrated, and maintains the male terminals 225 at set positions by making lances not illustrated which extends inside the male terminal accommodating room 229 engaged with the male terminals 225. As shown in FIGS. 21 and 23, the male terminal accommodating room 229 is formed by making an opening end 247 which opens at a front end surface 245 of the base 231 communicate axially with a through hole 249 which penetrates through the electric wire holding part 233 axially. The base 231 is formed with a male side annular part 251 made of resin which has an outer peripheral surface which is reduced stepwise over the entire periphery, at the opening end of the female terminal accommodating room 229. The male side annular part 251 has a front end surface 245 of the base 231, is formed into a tubular shape, and is surrounded by the hood part 235.

As shown in FIG. 20, the male housing 217 has a locking arm 253 which extends forward axially along the outer surfaces of the base 231 and the hood part 235 into a cantilever shape. The locking arm 253 is formed to have two legs 257 which are respectively supported on a pair of walls 255 which rises upward from the two side surfaces in the width direction of the base 231, a base end 259 which links these legs 257 to be supported, and an arm 261 which extends forward from the base end 259.

The front end of the arm 261 of the locking arm 253 is able to be displaced upward from a horizontal direction with the base end 259 supported on the walls 255 as a fulcrum. As shown in FIG. 23, the lower part of the front end of the arm 261 is provided with a locking part 263 which projects downward. As shown in FIG. 20, the walls 255 link the wall 239 of the hood part 235 to surround the locking arm 253 and are formed to rise up to a frame shape. The region around the locking arm 253 formed by being surrounded by the walls 139, 155 is opened to face the inside from the outside of the male housing 217. The upper end surface of the locking arm 253 is set at the same height as or a height lower than those of the upper end surfaces of the walls 239,255.

As shown in FIG. 18, the male terminal 221 is formed of a conductive metal plate or the like, and integrally includes an electric wire connecting part 265 which is crimped and connected to the core wire of the electric wire 225, and a male tab 267 which is connected to the female terminal 223. The male tab 267 is formed into a stick shape to extend forward/backward. While the male terminal 221 is maintained in the set position of the male terminal accommodating room 229, the male tab 267 projects from the opening end 245 and extends forward beyond the front end of the male side annular part 251.

Figure 22:
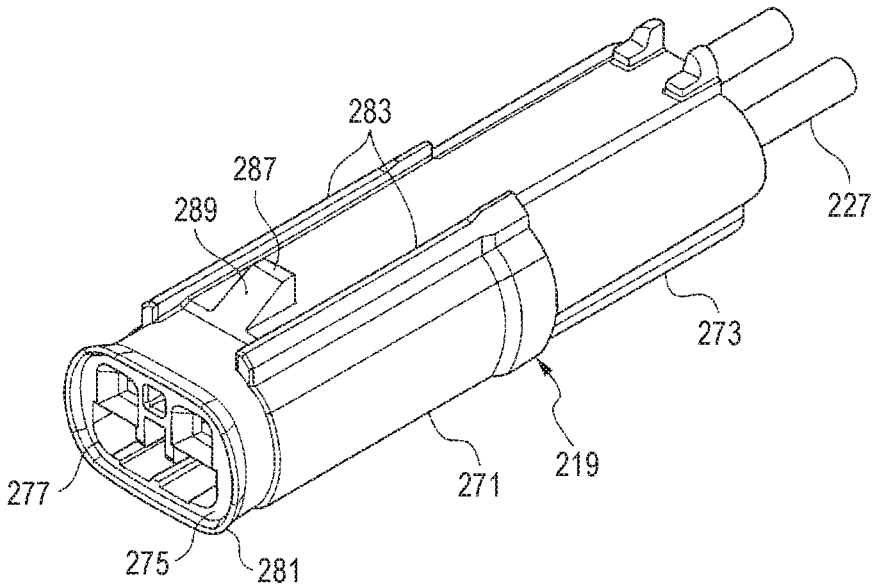
FIG. 22 is an appearance perspective view of the female connector.

On the other hand, as shown in FIG. 18, the female connector 215 has the female housing 219, which is formed of insulative synthetic resin into a cylindrical shape, and the female terminals 223 which are accommodated in the female housing 219 from the back side. As shown in FIGS. 22 and 23, the outer peripheral surface of the female housing 219 is formed so that the cross section, perpendicular to the axial direction is substantially similar to the inner peripheral surface of the hood part 235 of the male housing 217, and the female housing 19 is formed by integrally including a base 271 in which two female terminal accommodating rooms 269 (cavities) into which the female terminals 223 are inserted are formed, and an electric wire holding part 273 which projects backward from the base 271. The female terminal accommodating rooms 269 are formed to separate the two female terminals 223 from each other by separating walls not illustrated, and maintain the female terminals 21 at set positions by making lances not illustrated which extends inside the female terminal accommodating rooms 269 engaged with the female terminals 223.

As shown in FIGS. 22 and 23, the female terminal accommodating room 269 is formed by making an opening end 277 which opens at a front end surface 275 of the base 271 communicate axially with a through hole 279 which penetrates through the electric wire holding part 273 axially. The base 271 is provided with a female side annular part 281 made of resin which extends toward the male housing 217 from the fringe of the front end surface 275, at the opening end of the female terminal accommodating room 269. The female side annular part 281 is formed into an umbrella-like shape so that the inner and outer peripheral surfaces are widened toward the male housing 217, respectively.

The female housing 219 is provided with a pair of ridges 283 which extend axially from the top surface of the base 271 as shown in FIG. 22, and a step-like part 285 which extends axially from the bottom surface of the base 271 as shown in FIG. 23. The pair of ridges 283 are provided apart in the width direction and in parallel with each other, and become slidable along the inner peripheral surface of the male housing 217, respectively. The inner side of the pair of ridges 283 is provided with a locking part 287 which projects upward. The locking part 287 is provided with an inclined surface 289 which is inclined downward toward the front side of the base 271, and when the two housings are fitted together, the locking arm 253 of the male housing 217 is pushed up along the inclined surface 293.

As shown in FIG. 19, the female terminal 223 is formed of a conductive metal plate or the like, and integrally includes an electric wire connecting part 291 which is crimped and connected to the core wire of the electric wire 227, and a rectangular tubular electrical contact part 293 which the male tab 267 of the male terminal 221 is inserted into and connected with. The electrical contact part 293 is provided with a distal end which is at a position backward only a predetermined distance from the opening end 277 of the base 271, while the female terminal 223 is maintained at the set position of the female terminal accommodating room 269.

Figure 24:
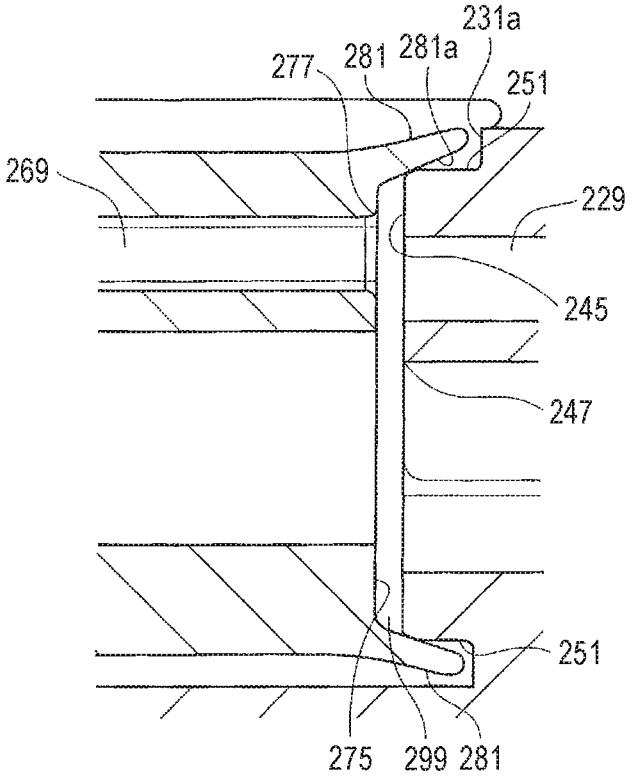
FIG. 24 is a partially enlarged view of FIG. 23.
Figure 25:
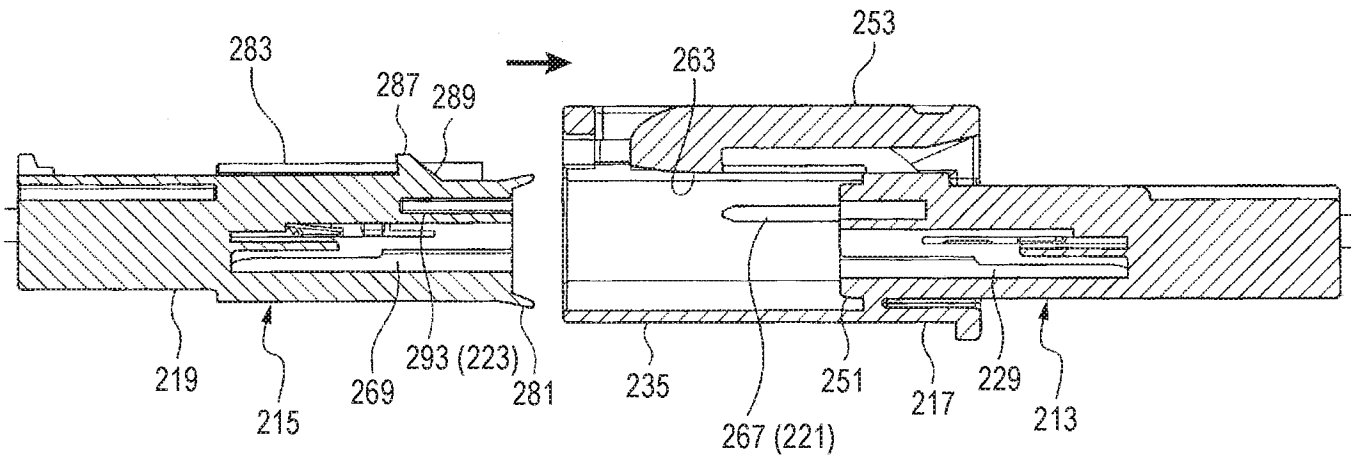
FIG. 25 is an illustration of movement before the male connector and the female connector are fitted together.

For the connector 211 of the present embodiment, as shown in FIGS. 23 and 24, when the male housing 217 and the female housing 219 are fitted together, the male side annular part 251 at the opening end of the male housing 217 and the female side annular part 281 at the opening end of the female housing 219 abut against each other. That is, an inner peripheral surface 281*a* of the female side annular part 281, which is widened toward the male housing 217, abuts against (coheres to) the fringe of the front end surface 245 (opening end 247) of the male side annular part 251 over the entire periphery. At this time, the axial length of the outer peripheral surface of the male side annular part 251 is set so that the distal end of the female side annular part 281 does not contact an end surface 231*a* of the base 231.

The female side annular part 281 is formed to have a relatively big resilience by setting into a predetermined thickness over the entire periphery. As shown in FIG. 24, the female side annular part 281 is formed elastically deformable so that the female side annular part 281 is pushed wide outward when the female side annular part 281 abuts against the male side annular part 251 which has a relatively big rigidity, and thereby the gap between the opening end 247 of the male terminal accommodating room 229 and the opening end 277 of the female terminal accommodating room 269 is watertightly sealed.

The female side annular part 281 forming a watertightly sealed state with the male side annular part 251 in this way is formed into a shape to flex to press the male side annular part 251 over the entire periphery when the pressure inside the connector 211 (for example, terminal accommodating rooms 229, 269) becomes a negative pressure relative to outside pressure (atmospheric pressure), and a predetermined difference in pressure occurs. The shape in this case includes the thickness, angle relative to the axial direction, and external shape of the female side annular part 251.

In contrast, the male side annular part 251 is formed to have a relatively higher rigidity so that even if the pressure in an inner space 299 becomes a negative pressure, the male side annular part 25 will not flex.

Then, an example of the movement when the two housings are fitted together is described. At first, as shown in FIG. 18, the male terminals 221 to which the electric wires 225 to which rubber stoppers 295 are mounted are connected are accommodated together with the rubber stoppers 295 in the male terminal accommodating room 229 of the male housing 217. Further, the female terminals 223 to which the electric wires 227 to which rubber stoppers 297 are mounted are connected are accommodated together with the rubber stoppers 297 in the female terminal accommodating rooms 269 of the female housing 219. In this state, as shown with the arrow of FIG. 25, the female housing 219 and the male housing 217 is brought close to each other.

When the female housing 219 is inserted into the hood part 235 of the male housing 217, the pair of ridges 283 of the female housing 219 pass the first cut parts 241 of the male housing 217, respectively, and the locking part 87 of the female housing 219 passes the second cut part 243 of the male housing 217. Further, the step-like part 285 of the female housing 219 is guided along the guiding groove 237 of the male housing 217.

When the insertion of the female housing 219 advances, the locking arm 253 of the male housing 217 is moved along the inclined surface 289 of the locking part 287 of the female housing 219 onto the locking part 287, and the arm 261 flexes upward. Then, after the locking part 263 of the arm 261 moves beyond the locking part 287, the arm 261 restores elastically. Thereby, the locking part 287 is locked to the locking part 263, and the two housings are locked in a regularly fitted position.

Along with this, the inner peripheral surface 281*a* of the female side annular part 281 is pressed and pushed wide over the entire periphery to the fringe of the front end surface 245 of the male side annular part 251, but because a restoring force which occurs due to this elastic deformation pushes the male side annular part 251, the male side annular part 251 and the female side annular part 281 are adhered to each other over the entire periphery. Thereby, the gap between the opening end 247 of the male terminal accommodating room 229 and the opening end 277 of the female terminal accommodating room 269 is watertightly sealed.

The pressure in the space (referred to as the inner space 299 below) of the connector 211 including the male terminal accommodating room 229 and the female terminal accommodating room 269 which are watertightly sealed in this way may become a negative pressure lower than the atmospheric pressure due to a temperature difference from the outside temperature or the like. In this case, it is concerned that liquid which is attached to the outer peripheral surfaces of the annular parts 251, 281 or the like may be taken into the inner space 299 from a small gap at the abutting portion of the male side annular part 251 and the female side annular part 281, by the difference in pressure.

In this regard, in the present embodiment, the female side annular part 281 having resilience (flexibility) flexes due to the negative pressure of the inner space 299, and presses the fringe of the front end surface 245 of the male side annular part 251. Therefore, because the watertightness of the abutting portion of the male side annular part 251 and the female side annular part 281 is raised when the inner space 299 has a negative pressure, it can be prevented that liquid invades into the inner space 299. In this case, because the male side annular part 251 is rigid, and will not flex due to the negative pressure, the male side annular part 251 is pressed surely by the female side annular part 281.

Because in the male terminal accommodating room 229, the gap between the outer peripheral surface of the electric wire 25 and the inner peripheral surface of the through hole 249 is sealed with the rubber stopper 295, and in the female terminal accommodating room 269, the gap between the outer peripheral surface of the electric wire 227 and the inner peripheral surface of the through hole 279 is sealed with the rubber stopper 297, water will not invade from the through holes 249, 279 even if an negative pressure occurs.

As described above, according to the connector 211 of the present embodiment, because when the inner space 299 has a negative pressure, the female side annular part 281 flexes and pushes the male side annular part 251 over the entire periphery, it can be prevented that liquid invades the inner space 299 from the gap at the abutting portion of the two annular parts, and a waterproofness drop of the connector 211 can be inhibited. Therefore, a short circuit, corrosion or the like between the terminals accommodated in the inner space 299 can be prevented, and electrical reliability of the connector 211 can be raised.

For the connector 211 of the present embodiment, because the male side annular part 251 and the female side annular part 281 are formed of resin respectively, and the inner space 299 is watertightly sealed by making the male side annular part 251 and the female side annular part 281 abut against each other, a rubber packing for waterproofing or the like becomes unnecessary. Therefore, a waterproofness drop caused by deterioration over time of the rubber packing, damage due to high pressure water or the like can be prevented, and the waterproofness of the connector 211 can be maintained for a long time. In addition, because the space where the rubber packing is provided becomes unnecessary, the connector 211 can be downsized, and the production cost can be reduced.

Because the female side annular part 281 has resilience (spring property), and is formed to press the male side annular part 251 over the entire periphery, even if, for example, vibration is transmitted to the connector 211, and the two annular members 251, 281 vibrate axially, the female side annular part 281 elastically deforms to absorb the vibration while maintaining a state of contacting the male side annular part 251. Thereby, a backlash between the male and female housings will not occur, and deterioration over time or the like of the connector 211 with the vibration can be inhibited.

In the present embodiment, a watertightly sealed state is formed by making the female side annular part 281 which has relatively high resilience and the male side annular part 251 which has a high rigidity abut against each other, but it is also possible to construct by replacing the positions of the annular parts relative to the housings with each other. Furthermore, the male side annular part 251 of the present embodiment has such a structure that flexural deformation due to the difference in pressure will not occur by having the rigidity, but as far as watertightness with the female side annular part 281 can be ensured, some extent of flexural deformation can be allowed.

An embodiment of the present invention is described above in detail with reference to the figures, and in the following, other embodiments to perform the present invention are described. Because each of these embodiments substantially play the same operation effect as the above embodiment, in the following, only the constitution that is characteristic of each embodiment is described, and the description of those common constitutions to the above embodiment is omitted.

The connector 2101 of the present embodiment differs from the connector 211 of the above embodiment in that one annular part of the male side annular part and the female side annular part is formed into an umbrella shape which is narrowed toward the other annular part, and the distal end abuts against the outer peripheral surface of the other annular part which is widened from the distal end toward the back.

Figure 26:
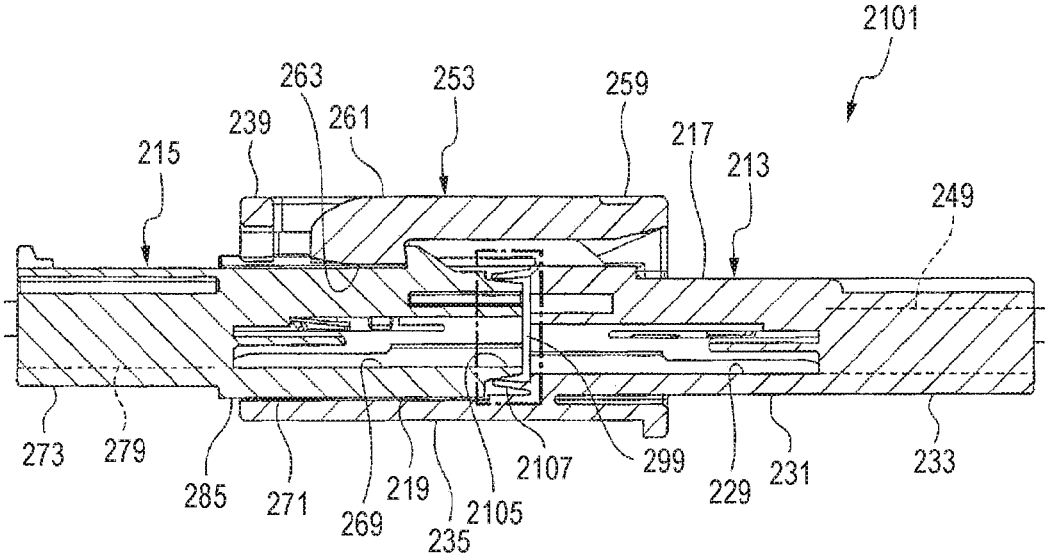
FIG. 26 is a sectional view of a connector corresponding to FIG. 23 of another embodiment.
Figure 27:
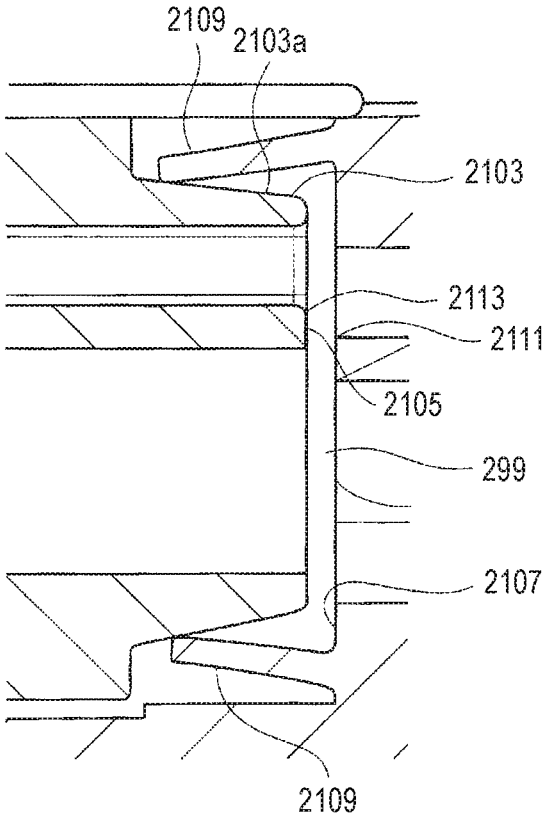
FIG. 27 is a partially enlarged view of FIG. 26.

FIGS. 26 and 27 show a section view of the connector 2101 in a fitted state in the present embodiment and an enlarged view of main parts of the connector 2101. The base 271 of the female housing 219 is formed with a female side annular part 2103 made of resin which has an outer peripheral surface which is lowered stepwise over the entire periphery at the opening end of the female terminal accommodating room 269. The female side annular part 2103 has an outer peripheral surface 2103*a* which is widened from a front surface 2105 of the female side annular part 2103 toward the back, and is formed to have a relatively higher rigidity so that even if the inner space 299 has a negative pressure, the female side annular part 2103 will not flex.

On the other hand, the base 231 of the male housing 217 is provided with a male side annular part 2109 made of resin which extends toward the female side annular part 2103 from a front end surface 2107 of the base 231, at the opening end of the male terminal accommodating room 229. The male side annular part 2109 is surrounded by the hood part 235, and has a relatively high resilience, and the inner and outer peripheral surfaces of the male side annular part 2109 is formed into a tapered umbrella shape. The male side annular part 2109 is formed to be able to press the outer peripheral surface 2103*a* of the female side annular part 2103 when the male and female housings are fitted together, and is formed into a shape to flex to press the outer peripheral surface 2103*a* of the female side annular part 2103 when the inner space 99 of the connector 2101 has a negative pressure, and a predetermined pressure difference from the atmospheric pressure is produced.

According to the present embodiment, because the female side annular part 2103 is pressed to the male side annular part 2109 over the entire periphery, the gap between an opening end 2111 of the male terminal accommodating room 229 and an opening end 2113 of the female terminal accommodating room 269 is watertightly sealed.

Particularly, because the male side annular part 2109 which has resilience flexes to push the outer peripheral surface 2103*a* of the female side annular part 2103, when the inner space 299 has a negative pressure relative to the atmospheric pressure, watertightness of the abutting portion of the female side annular part 2103 and the male side annular part 2109 is raised, and it can be prevented that liquid is taken into the inner space 299.

In the present embodiment, because the male side annular part 2109 which has resilience is formed into a tapered umbrella type, even if, for example, high pressure washing liquid enters the inside of the hood part 235 through an opening around the locking arm 253, and is blown against the male side annular part 2109, an up-rolling of the male side annular part 2109 can be inhibited. Therefore, the watertightness of the abutting portion of the male side annular part 2109 and the female side annular part 2103 is maintained, and it can be prevented that water invades the inner space 299.

In the present embodiment, a watertight sealing structure is formed by making the male side annular part 2109 which has relatively high resilience and the female side annular part 2103 which has a high rigidity abut against each other, but it is also possible to construct by replacing the positions of the annular parts relative to the housings with each other. Furthermore, the female side annular part 2103 of the present embodiment has such a structure that flexural deformation due to the difference in pressure will not occur by having the rigidity, but as far as the watertightness with the male side annular part 2109 can be ensured, some extent of flexural deformation can be allowed.

Then, another embodiment is described. A connector of the present embodiment differs from the connector 211 of the above embodiment in that, a male side annular part and a female side annular part made of resin are formed into a tapered umbrella shape toward the opposite side, respectively, and the distal end surfaces of the male side annular part and the female side annular part abut against each other.

Figure 28:
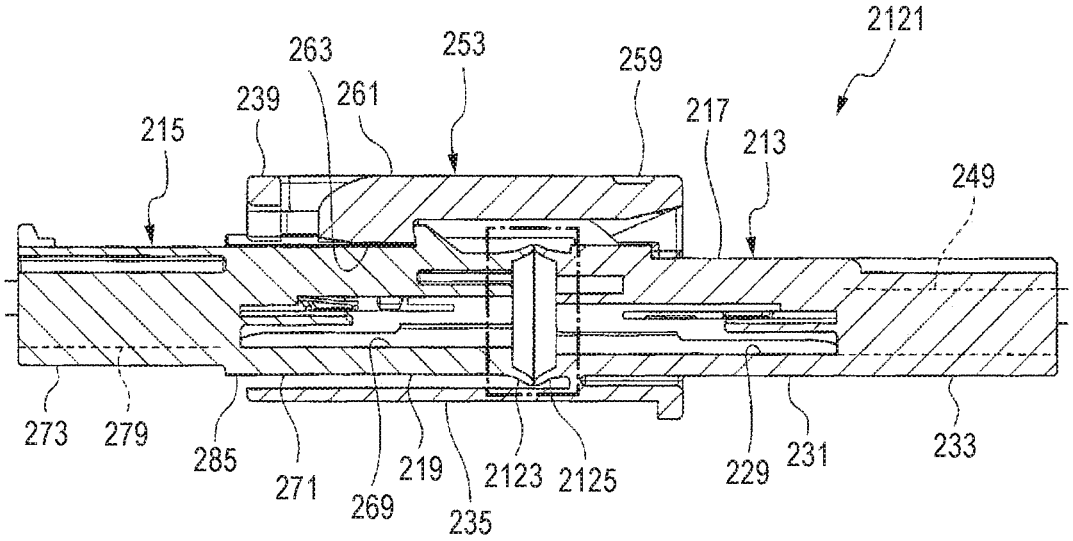
FIG. 28 is a sectional view of a connector corresponding to FIG. 23 of another embodiment.
Figure 29:
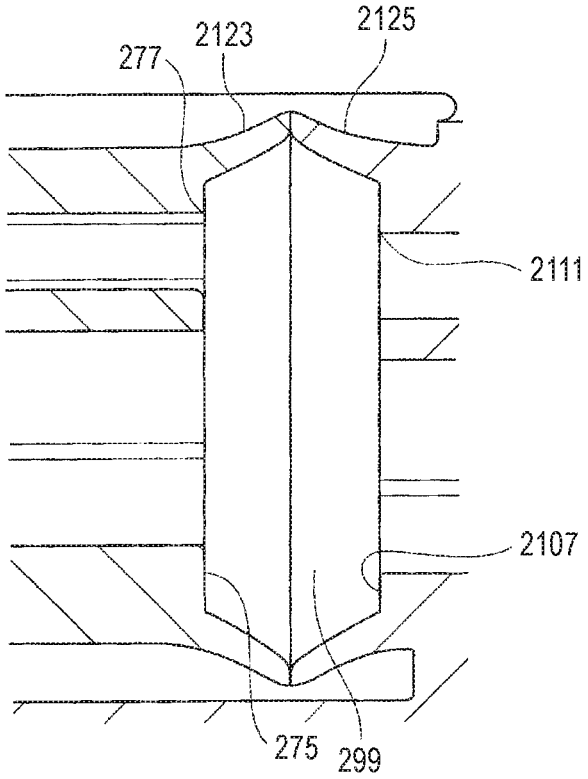
FIG. 29 is a partially enlarged view of FIG. 28.

FIGS. 28 and 29 show a section view of a connector 2121 in a fitted state in the present embodiment and an enlarged view of main parts of the connector 2121. A female side annular part 2123 of the present embodiment is formed into an umbrella type which is widened toward a male side annular part 2125, and is constructed like the female side annular part 281 of FIG. 23. On the other hand, the male side annular part 2125 is placed to be symmetrical to the female side annular part 2123 in the forward/backward direction, and is formed into an umbrella shape which extends to be widened toward the female side annular part 2123 from a front surface 2107 of the base 231. The female side annular part 2123 and the male side annular part 2125 are formed to be able to press the opposite annular part, respectively, by abutting over the entire periphery against the distal end surfaces (front end surfaces) mutually when the male and female housings are fitted together, and are formed into a shape to flex to press the opposite annular part when the inner space 299 of the connector 2121 has a negative pressure, and a predetermined pressure difference from the atmospheric pressure is produced.

According to the present embodiment, the female side annular part 2123 and the male side annular part 2125 press the end surfaces mutually over the entire periphery. Therefore, the watertightness of the gap between the two end surfaces can be raised higher than those of the above embodiments, and the gap between an opening end 2111 of the male terminal accommodating room 229 and an opening end 2113 of the female terminal accommodating room 269 can be watertightly sealed more surely.

Particularly, because the female side annular part 2123 and the male side annular part 2125 flex respectively and push the opposite annular part, when the inner space 299 has a negative pressure relative to the atmospheric pressure, the watertightness of the abutting portion of the female side annular part 2123 and the male side annular part 2125 is raised higher than those of the above embodiments, and it can be more surely prevented that liquid is taken into the inner space 299.

It is described in the present embodiment that, the female side annular part 2123 and the male side annular part 2125 abut against each other at the end surfaces, but the female side annular part 2123 and the male side annular part 2125 can be formed so that the distal end of one of the female side annular part 2123 and the male side annular part 2125 abuts against the inner peripheral surface of the other. In this case, the one annular part that abuts against the inner peripheral surface of the other is formed so that the flexural extent is less than that of the other annular part, so that even if the inner space 299 has a negative pressure, the watertightness of the two annular parts can be ensured.

Fifth Embodiment

The fifth embodiment of a connector waterproofing structure which the present invention is applied to is described as follows with reference to FIGS. 30 to 37. In this embodiment, a waterproof connector loaded in an automobile, a motorcycle or the like is described as an example, but the waterproofing structure of the present invention can be applied to connectors besides this kind of connector.

Figure 30:
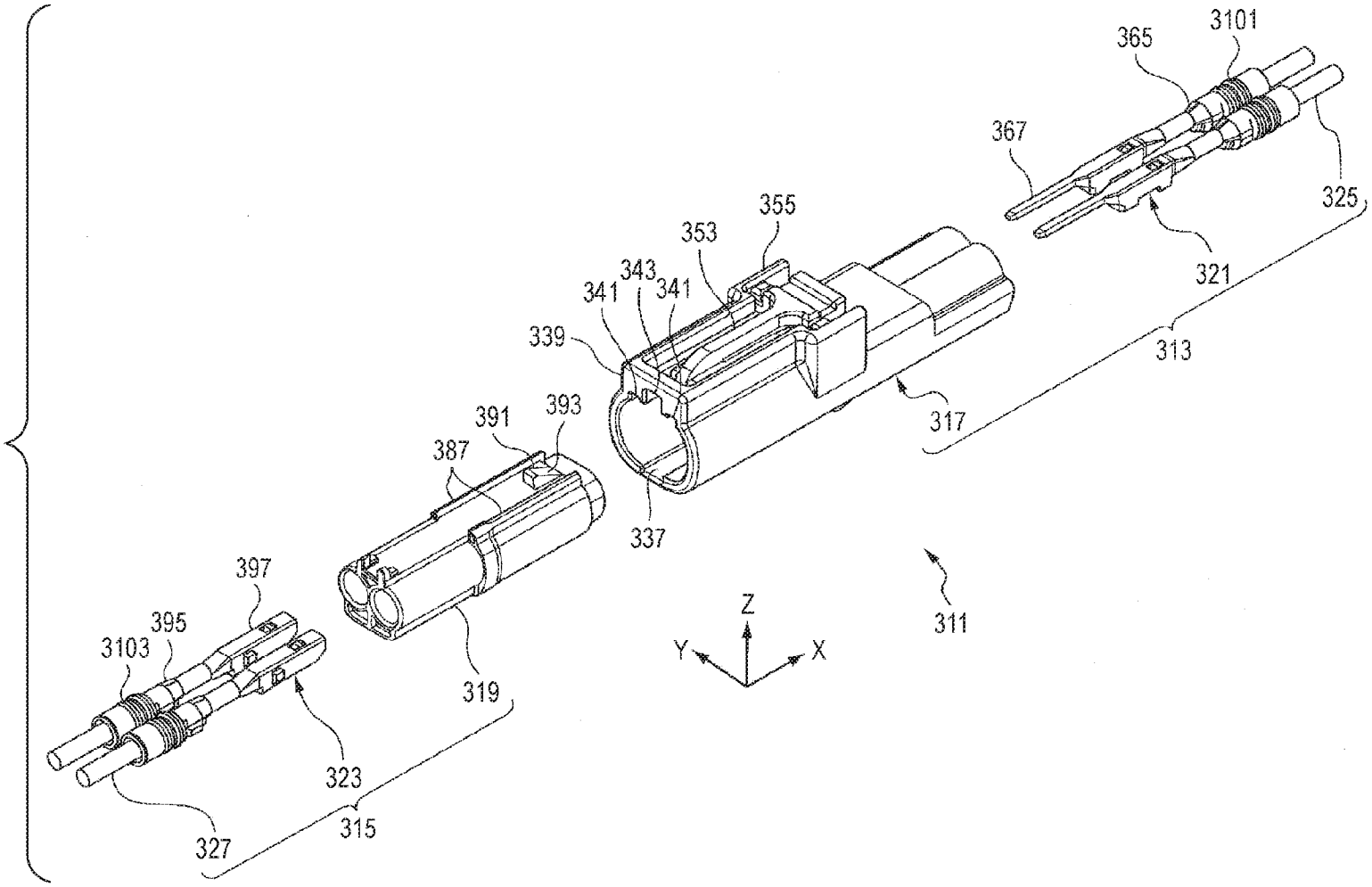
FIG. 30 is an exploded perspective view of a connector of an embodiment of the present invention.
Figure 31:
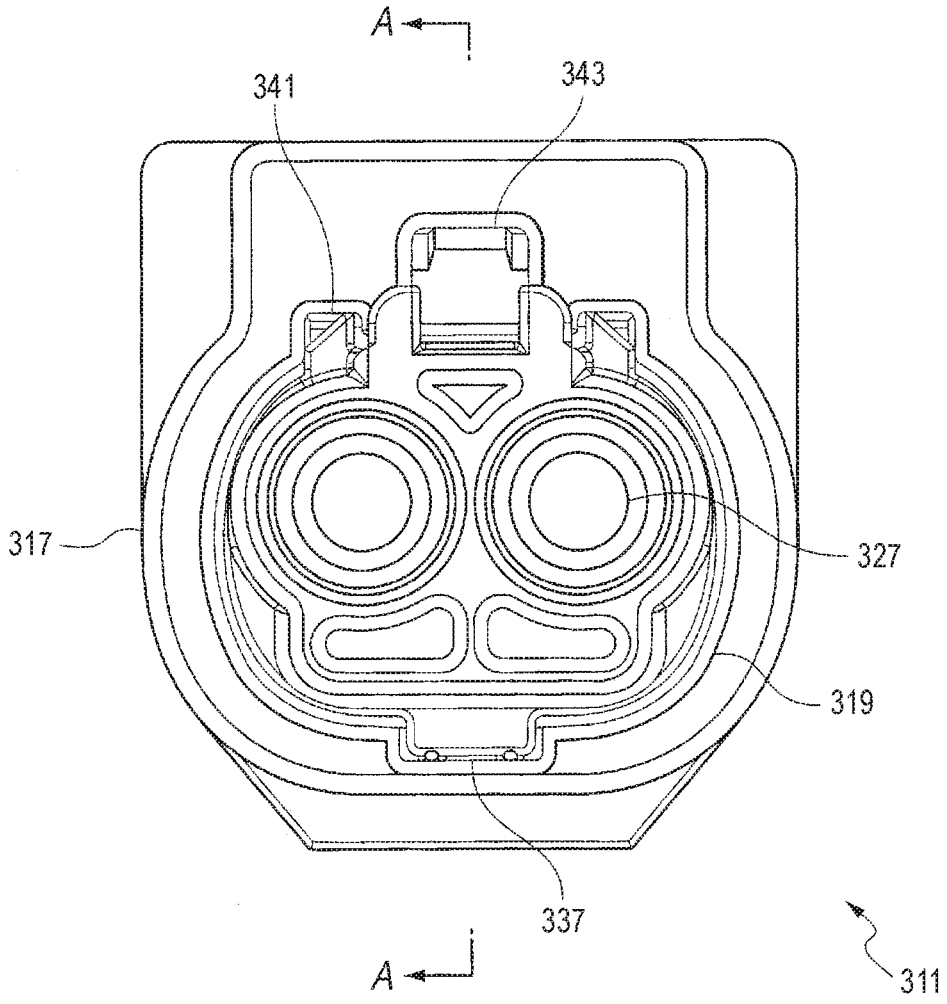
FIG. 31 is a figure of the connector of FIG. 30 when viewed from the back side of a female connector.

As shown in FIGS. 30 and 31, a connector 311 of the present embodiment includes a male connector 313 and a female connector 315, and when a male housing 317 of the male connector 313 and a female housing 319 of the female connector 315 are fitted together (engaged) with each other, male terminals 321 which are accommodated in the male housing 317 and female terminals 323 which are accommodated in the female housing 319 are electrically connected. Electric wires 325 are connected to the male terminals 321, and electric wires 327 are connected to the female terminals 323. The female housing 319 is locked to the male housing 317 while one end side of the female housing 319 is fitted into the inside of the male housing 317. In this embodiment, an example in which two terminals are accommodated in each connector is described, but the number of the terminals which are accommodated is not limited to two. In the following description, in FIG. 30, the X direction is defined as a forward/backward direction, the Y direction as a width direction, the Z direction as a height direction, the fitting directions of the two connectors respectively as a forward direction, and the upper side of FIG. 10 as an upside.

Figure 32:
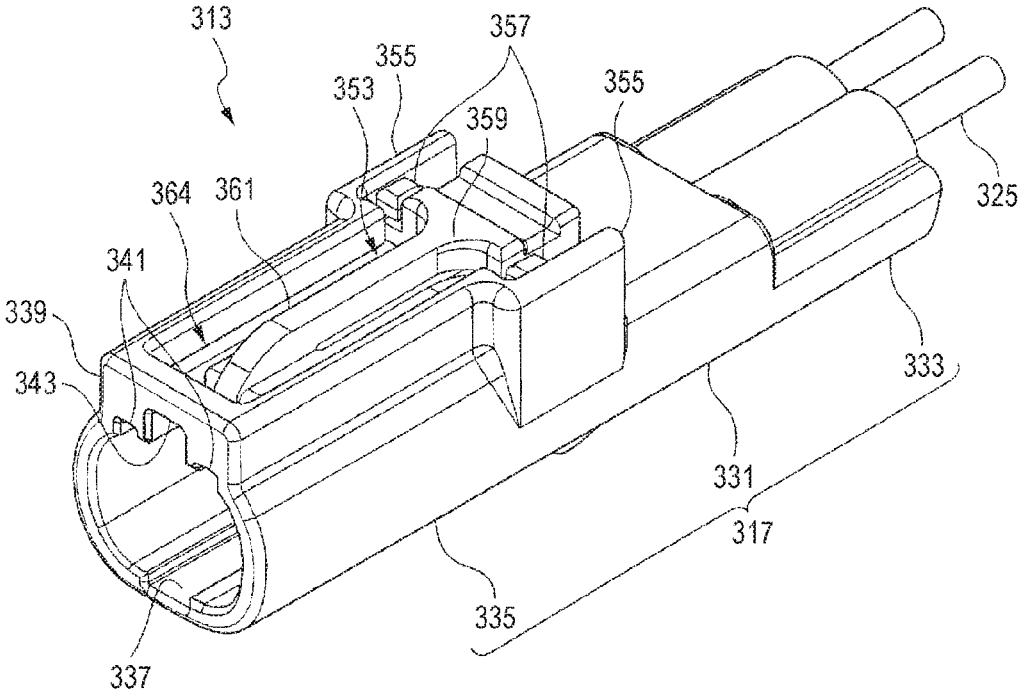
FIG. 32 is an appearance perspective view of a male connector.
Figure 35:
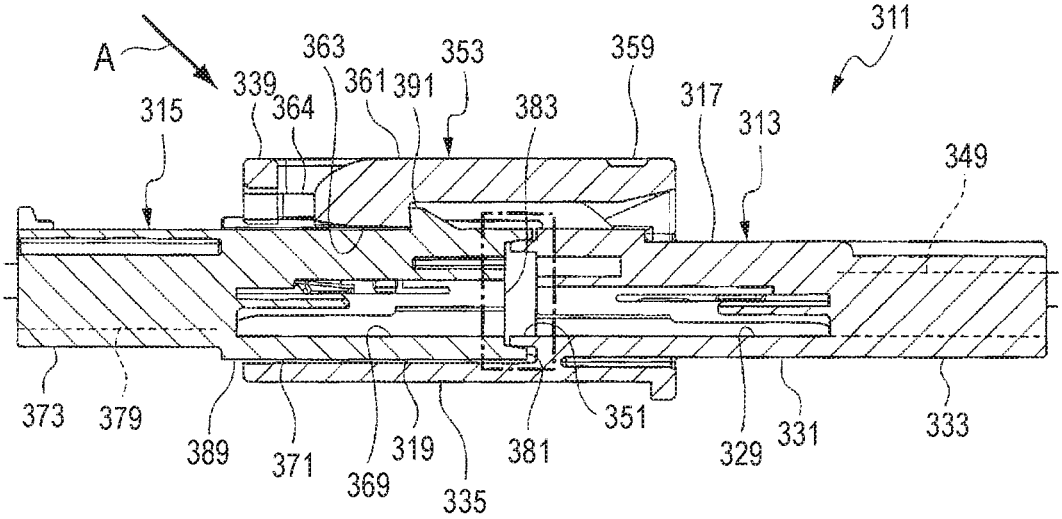
FIG. 35 is an A-A arrow sectional view of FIG. 31.

As shown in FIGS. 30 and 32, the male connector 313 has the male housing 317, which is formed of insulative synthetic resin into a cylindrical shape, and the male terminals 321, which are accommodated in the male housing 317 from the back side. As shown in FIG. 35, the male housing 317 is formed by integrally including a tubular base 331 in which a male terminal accommodating room 329 (cavity), in which the male terminals 321 are accommodated, is formed, an electric wire holding part 333 which projects backward from the base 331, and a hood part (pipe part) 335 which projects forward along the outer peripheral surface of the base 331. The cross section perpendicular to the axial direction of the hood part 335 is formed into an oval cylindrical shape, and the female housing 319 is inserted into the hood part 335.

As shown in FIG. 32, the inner surface of the hood part 335 is formed with a guiding groove 337 which extends axially. A wall 339 which rises up into a board-like shape and which is flush with the front end surface of the hood part 335 is provided with a pair of first cut parts 341 and a second cut part 343 which is formed at the inner side of the pair of first cut parts 341.

Figure 33:
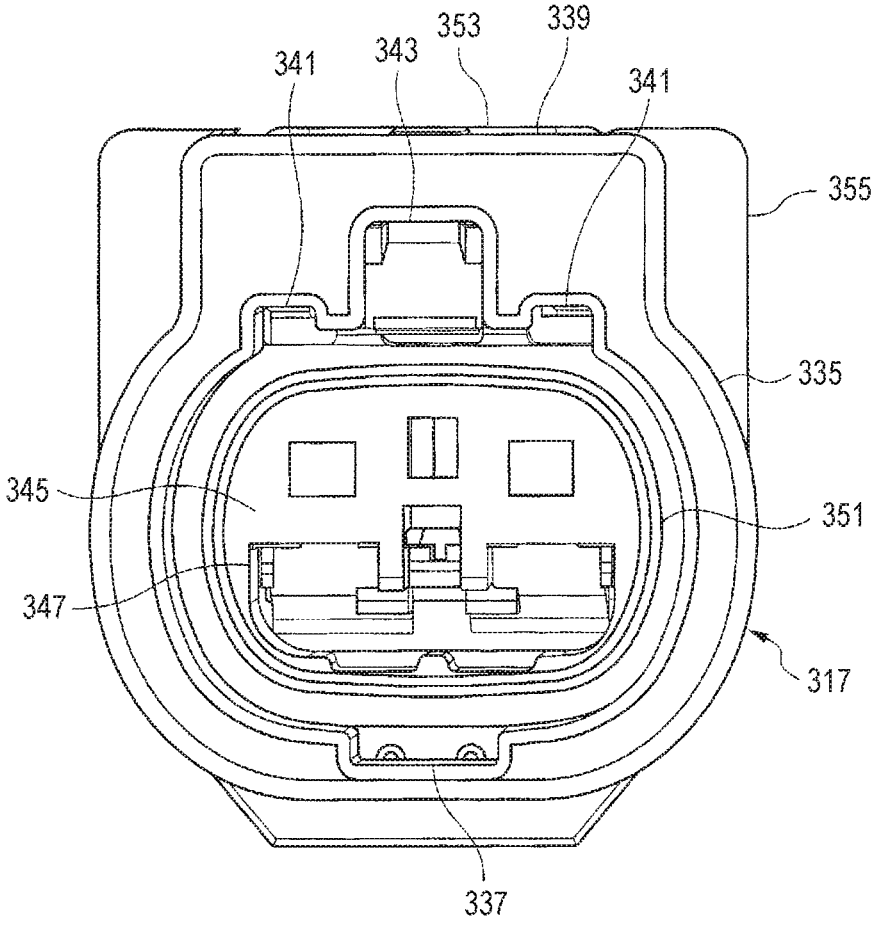
FIG. 33 is a front view of a male housing of the male connector of FIG. 32.

The male terminal accommodating room 329 accommodates the two male terminals 325 which are separated from each other by separating walls not illustrated, and maintains the male terminals 325 at set positions by making lances not illustrated which extends inside the male terminal accommodating room 329 engaged with the male terminals 325. As shown in FIGS. 33 and 35, the male terminal accommodating room 329 is formed by making an opening end 347 which opens at a front end surface 345 of the base 331 communicate axially with a through hole 349 which penetrates through the electric wire holding part 333 axially. The front end surface 345 of the base 331 is formed with an inside annular part 351 made of resin which extends forward axially from the fringe of the opening end 347. The inside annular part 351 is formed into an annular shape to have an outer peripheral surface which is reduced stepwise over the entire periphery from the outer peripheral surface of the base 331, and is surrounded by the hood part 335.

As shown in FIG. 32, the male housing 317 has a locking arm 353 which extends forward axially along the outer surfaces of the base 331 and the hood part 335 into a cantilever shape. The locking arm 353 is formed to have two legs 357 which are respectively supported on a pair of walls 355 which rises upward from the two side surfaces in the width direction of the base 331, a base end 359 which links these legs 357 to be supported, and an arm (arm piece) 361 which axially cuts the hood part 335 and extends forward from the base end 359 into a cantilever shape.

The front end of the arm 361 of the locking arm 353 is able to be displaced upward from a horizontal direction with the base end 359 supported on the walls 355 as a fulcrum. As shown in FIG. 35, the lower part of the front end of the arm 361 is provided with a locking part 363 which projects downward. As shown in FIG. 32, the walls 355 link the wall 339 of the hood part 335 to surround the locking arm 353 and are formed to rise up to a frame shape. The region around the locking arm 353 formed by being surrounded by the walls 339, 355 is formed with an opening part 364 which cuts the outer walls of the hood part 335 to face the inside from the outside of the male housing 317. The upper end surface of the locking arm 353 is set at the same height as or a height lower than those of the upper end surfaces of the walls 339,355.

As shown in FIG. 30, the male terminals 321 is formed of a conductive metal plate or the like, and integrally includes an electric wire connecting part 365 which is crimped and connected to the core wire of the electric wire 325, and a male tab 367 which is connected to the female terminal 323. The male tab 367 is formed into a stick shape to extend forward/backward. While the male terminal 321 is maintained in the set position of the male terminal accommodating room 329, the male tab 267 projects from the opening end 347 and extends forward beyond the front end of the male side annular part 351.

Figure 34:
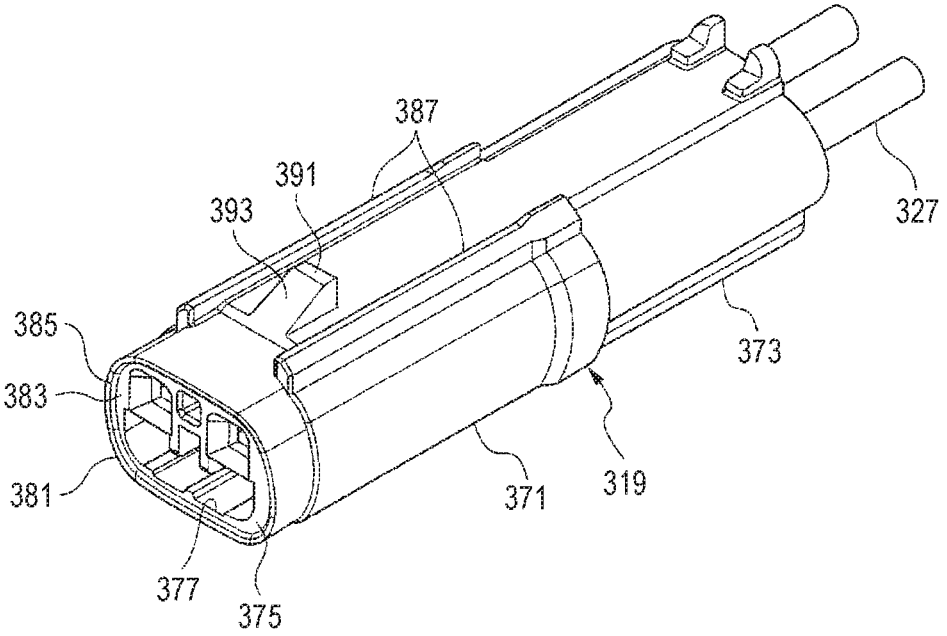
FIG. 34 is an appearance perspective view of the female connector.

On the other hand, as shown in FIG. 30, the female connector 315 has the female housing 319, which is formed of insulative synthetic resin into a cylindrical shape, and the female terminals 323 which are accommodated in the female housing 319 from the back side. As shown in FIGS. 34 and 35, the outer peripheral surface of the female housing 319 is formed so that the cross section, perpendicular to the axial direction is substantially similar to the inner peripheral surface of the hood part 335 of the male housing 317, and the female housing 19 is formed by integrally including a base 371 in which two female terminal accommodating rooms 369 (cavities) into which the female terminals 323 are inserted are formed, and an electric wire holding part 373 which projects backward from the base 371. The female terminal accommodating rooms 369 are formed to separate the two female terminals 323 from each other by separating walls not illustrated, and maintain the female terminals 21 at set positions by making lances not illustrated which extends inside the female terminal accommodating rooms 369 engaged with the female terminals 323.

As shown in FIGS. 34 and 35, the female terminal accommodating room 369 is formed by making an opening end 377 which opens at a front end surface 375 of the base 371 communicate axially with a through hole 379 which penetrates through the electric wire holding part 373 axially. The front end of the base 371 is formed to have an outside annular part 381 which abuts against the inside annular part 351 when the male and female housings are fitted together, and a recess 383 in which the distal end of the inside annular part 351 is accommodated. The recess 383 is formed by being surrounded by the inner peripheral surface 385 of the outside annular part 381 and the front end surface 375 of the base 371.

The female housing 319 is provided with a pair of ridges 387 which extend axially from the top surface of the base 371 as shown in FIG. 34, and a step-like part 389 which extends axially from the bottom surface of the base 371 as shown in FIG. 35. The pair of ridges 387 are provided apart in the width direction and in parallel with each other, and become slidable along the inner peripheral surface of the male housing 317, respectively. The inner side of the pair of ridges 387 is provided with a locking part 391 which projects upward. The locking part 391 is provided with an inclined surface 393 which is inclined downward toward the front side of the base 371, and when the two housings are fitted together, the locking arm 353 of the male housing 317 is pushed up along the inclined surface 393.

As shown in FIG. 30, the female terminal 323 is formed of a conductive metal plate or the like, and integrally includes an electric wire connecting part 395 which is crimped and connected to the core wire of the electric wire 327, and a rectangular tubular electrical contact part 397 which the male tab 367 of the male terminals 321 is inserted into and connected with. The electrical contact part 397 is provided with a distal end which is at a position backward only a predetermined distance from the opening end 377 of the base 371, while the female terminal 323 is maintained at the set position of the female terminal accommodating room 369.

Figure 36:
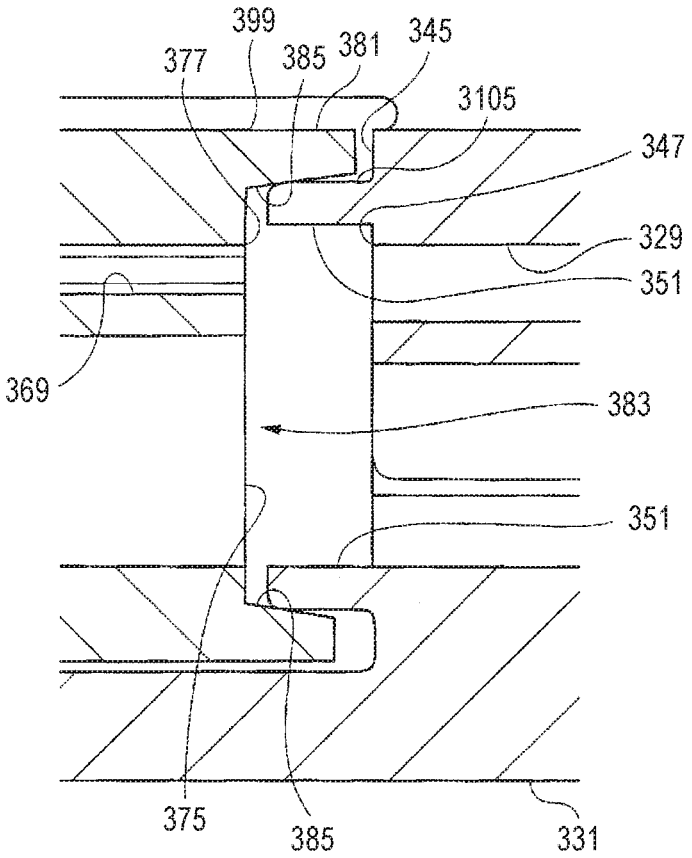
FIG. 36 is a partially enlarged view of FIG. 35.
Figure 37:
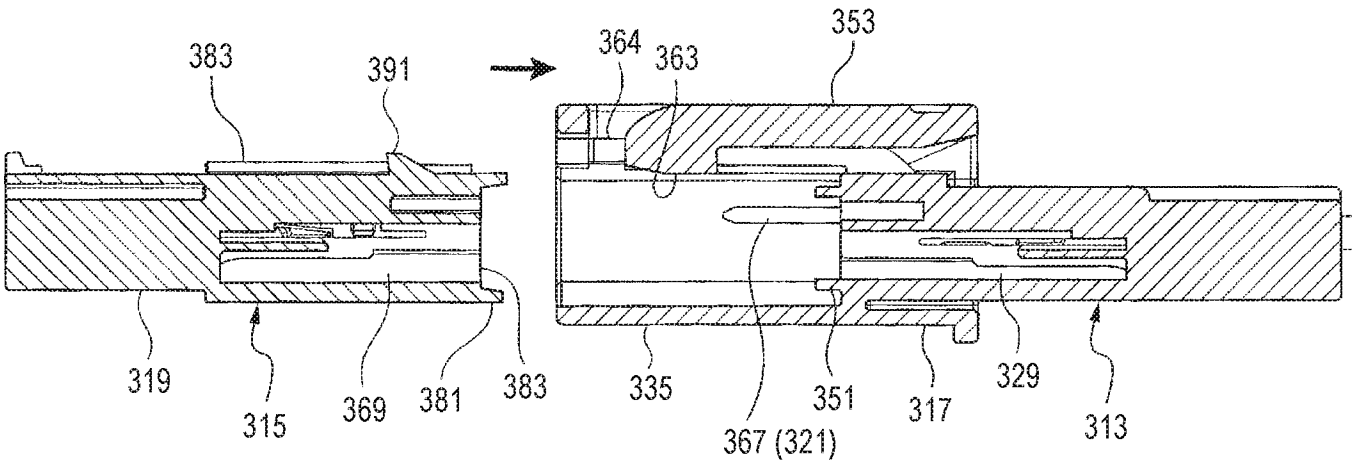
FIG. 37 is an illustration of movement before the male connector and the female connector are fitted together.

For the connector 311 of the present embodiment, when the male housing 317 and the female housing 319 are fitted together, as shown in FIGS. 35 and 36, the inside annular part 351 which is formed at the fringe of the opening end 347 of the male terminal accommodating room 329 and the outside annular part 381 which is formed at the fringe of the opening end 377 of the female terminal accommodating room 369 abut against each other, and the gap between the opening end 347 and the opening end 377 is watertightly sealed.

The radial thickness of the inside annular part 351 is set to a predetermined thickness in the axial direction, and the inside annular part 351 is formed to have a relatively high resilience. The axial length of the inside annular part 351 is set to such a length that the distal end of the outside annular part 381 will not abut against the front surface 345 of the base 331 when the male housing 317 and the female housing 319 are fitted together.

The outside annular part 381 is formed to have an outer peripheral surface 399 which is flush with the outer peripheral surface of the portion (distal end of the base 371) of the female housing 319 where the outside annular part 381 is formed, and an inner peripheral surface 385 which has a tapered inclined surface so that the wall thickness is increased from the distal end toward the back. The inner peripheral surface 385 is so formed that the distal end of the inside annular part 351 may abut over the entire periphery against the inner peripheral surface 385 when the male housing 317 and the female housing 319 are fitted together. The outside annular part 381 is formed to have a rigidity at least higher than that of the inside annular part 351, and has such a strength not to deform when being pressed to the inside annular part 351.

In this embodiment, when the male housing 317 and the female housing 319 are fitted together, if the inside of the hood part 335 is viewed through the opening part 364 from the outside of the hood part 335, the outside annular part 381 is located at a position facing the opening part 364, that is, in the visible range.

Then, an example of the movement when the two housings are fitted together is described. At first, as shown in FIG. 30, the male terminals 321 to which the electric wires 325 to which rubber stoppers 3101 are mounted are connected are accommodated together with the rubber stoppers 3101 in the male terminal accommodating room 329 of the male housing 317. Further, the female terminals 323 to which the electric wires 327 to which rubber stoppers 3103 are mounted are connected are accommodated together with the rubber stoppers 3103 in the female terminal accommodating rooms 369 of the female housing 319. In this state, as shown with the arrow of FIG. 37, the male housing 317 of the male connector 313 and the female housing 319 of the female connector 315 is brought close to each other.

When the female housing 319 is inserted into the hood part 335 of the male housing 317, the pair of ridges 387 of the female housing 319 pass the first cut parts 341 of the male housing 317, respectively, and the locking part 391 of the female housing 319 passes the second cut part 343 of the male housing 317. Further, the step-like part 389 of the female housing 319 is guided along the guiding groove 337 of the male housing 317.

When the insertion of the female housing 319 advances, the locking arm 353 of the male housing 317 is moved along the inclined surface 393 of the locking part 391 of the female housing 319 onto the locking part 391, and the arm 361 flexes upward. Then, after the locking part 363 of the arm 361 moves beyond the locking part 391, the arm 361 restores elastically. Thereby, the locking part 391 is locked to the locking part 363, and the two housings are locked in a regularly fitted position.

Along with this, the distal end of the inside annular part 351 presses the inner peripheral surface 385 of the outside annular part 381 over the entire periphery. At this time, the inside annular part 351 is pushed inward by elastic deformation because the rigidity of the outside annular part 381 is high, but because restoring force of this elastic deformation pushes the inner peripheral surface 385 of the outside annular part 381, the male side annular part 351 and the female side annular part 381 are abutted against each other over the entire periphery watertightly. Thereby, the gap between the opening end 347 of the male terminal accommodating room 329 and the opening end 377 of the female terminal accommodating room 369 is watertightly sealed.

For the connector 311 in which the male housing 317 and the female housing 319 are fitted together in this way, the inside of the hood part 335 is opened through the opening part 364 which is formed to surround the arm 361. Therefore, for example, when high pressure liquid for washing is blown against the connector 311 at the time of washing the vehicle, the high pressure liquid enters the inside of the hood part 335 through the opening part 364, and contacts the portion where the male side annular part 351 and the female side annular part 381 abut against each other. In this case, the inside annular part 351 which is relatively soft may deform or be damaged, because of the contact of the high pressure liquid, and, as a result, a gap is produced between the inside annular part 351 and the outside annular part 381, and waterproofness may be decreased.

In this regard, in the fifth embodiment, when the male housing 317 and the female housing 319 are fitted together, it is arranged that the outside annular part 381 which is more rigid than the inside annular part 351 is located at the outside of the inside annular part 351, and the distal end of the inside annular part 351 is accommodated in the recess 383 which is formed at the inside of the female housing 319. That is, the distal end of the inside annular part 351 is covered by the outside annular part 381. Therefore, even if the high pressure liquid that invades the hood part 335 may contact the outside annular part 381, the high pressure liquid will not contact the inside annular part 351. Because the outside annular part 381 has a predetermined rigidity, even if the high pressure liquid contacts the outside annular part 381, the outside annular part 381 will not deform. Therefore, according to the present embodiment, because deformation or damage of the inside annular part 351 can be prevented even when the vehicle is washed with high pressure liquid, a watertight state of the outside annular part 351 and inside annular part 381 can be maintained and a waterproofness drop of the connector 311 can be inhibited.

Because the opening part 364 of the hood part 335 is formed to extend toward the front side of the male housing 317 along the axial direction, the high pressure liquid which is blown against the portion where the inside annular part 351 and the outside annular part 381 abut against each other may not only enter the opening part 364 from the vertical direction, but also enter obliquely from the front side of the male housing 317, as shown with the arrow A of FIG. 35. Therefore, for example, if the outside annular part 381 is provided at the side of the male housing 317 opposite to that of the present embodiment and extends toward the female housing 319, because the exposed portion of the base end of the inside annular part 351 is located near the distal end of the outside annular part 381, the high pressure liquid becomes easy to contact this exposed portion.

In this regard, in the fifth embodiment, because the outside annular part 381 is provided at the side of the female housing 319, and is extended toward the male housing 317 side, as shown in FIG. 36, when an exposed portion 3105 of the base end of the inside annular part 351 is seen from the opening part 364, the exposed portion 3105 is hidden in the outside annular part 381. Therefore, even if the high pressure liquid enters from the direction of arrow A of FIG. 35, the high pressure liquid will not contact the exposed portion 3105 of the inside annular part 351, and a waterproofness drop of the connector 311 can be inhibited more surely.

As described above, for the connector 311 of the fifth embodiment, because the inside annular part 351 is covered with the outside annular part 381, it can be prevented that high pressure liquid contacts the inside annular part 351. Thereby, because deformation, damage or the like of the inside annular part 351 can be prevented, even when the vehicle is washed with high pressure liquid, a watertight state of the inside annular part 351 and the outside annular part 381 can be maintained, and a waterproofness drop of the connector 311 can be inhibited. Therefore, in the space watertightly sealed by the inside annular part 351 and the outside annular part 381, a short circuit between the terminals, corrosion of the terminals or the like can be prevented, and electrical reliability of the connector 311 can be raised.

For the connector 311 of the fifth embodiment, because the inside annular part 351 and the outside annular part 381 are formed of resin respectively, and the terminal accommodating rooms are watertightly sealed by making the inside annular part 351 and the outside annular part 381 abut against each other, a rubber packing for waterproofing or the like becomes unnecessary. Therefore, a waterproofness drop caused by deterioration over time of the rubber packing, damage due to high pressure water or the like can be prevented, and the waterproofness of the connector 311 can be maintained for a long time. In addition, because the space where the rubber packing is provided becomes unnecessary, the connector 311 can be downsized, and the production cost can be reduced.

Because the inside annular part 351 has resilience (spring property), and is formed to press the outside annular part 381 over the entire periphery, even if, for example, vibration is transmitted to the connector 311, and the two annular members 351, 381 vibrate axially, the outside annular part 381 elastically deforms to absorb the vibration while maintaining a state of contacting the inside annular part 351.

Thereby, a backlash between the male and female housings will not occur, and deterioration over time or the like of the connector 311 with the vibration can be inhibited.

The embodiment of the present invention is described above in detail with reference to the figures, but the above embodiment is only an illustration of the present invention, and the present invention can be modified and changed in the range recorded in the claims.

For example, the outside annular part 381 of the present embodiment is formed to have such a rigidity not to deform even if high pressure water contacts the outside annular part 381, but it is also possible that the outside annular part 381 at least has a rigidity higher than that of the inside annular part 351. That is, because the inside annular part 351 presses the inner peripheral surface 385 of the outside annular part 381 outward when the male housing 317 and the female housing 319 are fitted together, even if the outside annular part 381 deformed to some extent inward when high pressure water contacts the outside annular part 381, because the deformation direction of the outside annular part 381 is a direction to press the inside annular part 351, the contact state of the inside annular part 351 and the outside annular part 381 is ensured.

What is claimed is:

1. A connector waterproofing structure for watertightly sealing a gap between openings of cavities of a pair of housings which accommodate terminals, the connector waterproofing structure comprising:

a first annular member formed at a first end surface of a first one of the housings at a location that is adjacent to a first opening through the first end surface, a second annular member formed at a second end of a second one of the housings at a location that is adjacent to a second opening through the second end surface, the second annular member is deformed by engagement with the first annular member, wherein the second annular member is pressed to an outer peripheral surface of the first annular member, when the pair of housings are fitted together, and an end face of a tip end portion of the second annular member and an inner face of the tip end portion of the second annular member do not contact with the first annular member.

2. The connector waterproofing structure according to claim 1, wherein the annular members are made of resin, protrude from the respective end surface and surround the respective opening, and the inner peripheral surface or the outer peripheral surface of the first annular member is inclined so that the wall thickness of the first annular member is gradually increased from the distal end toward the back.

3. The connector waterproofing structure according to claim 2, wherein a distal end of the second annular member at a surface opposed to the first annular member is inclined in a direction away from the first annular member.

4. The connector waterproofing structure according to claim 2, wherein the distal end of the first annular member abuts against the second one of the housings when the pair of housings are fitted together.

5. The connector waterproofing structure according to claim 1, wherein the annular members are made of resin, protrude from the respective end surface and surround the respective opening, the second annular member is pressed to an inner peripheral surface or an outer peripheral surface of the first annular member, when the pair of housings are fitted together, and the inner peripheral surface or the outer peripheral surface of the first annular member includes an inclined surface in a middle from a distal end toward a base end of the first annular member so that the wall thickness of the first annular member is gradually increased toward the back.

6. The connector waterproofing structure according to claim 5, wherein the second annular member includes an inclined surface which engages the inclined surface of the inner peripheral surface or the outer peripheral surface of the first annular member when the pair of housings are fitted together.

7. The connector waterproofing structure according to claim 1, wherein the first annular member is an inside annular part and the second annular member is an outside annular part which are fitted together with each other at the openings, and the first one of the housings includes a cover body which covers an outer peripheral surface of an distal end of the outside annular part.

8. The connector waterproofing structure according to claim 7, wherein the first one of housings includes an annular groove whose opposed groove side surfaces are formed of the outer peripheral surface of the inside annular part and an inner peripheral surface of the cover body, respectively.

9. The connector waterproofing structure according to claim 7, wherein the outer peripheral surface of the inside annular part is inclined toward the second housing such that the inside annular part widens.

10. The connector waterproofing structure according to claim 7, wherein the outside annular part abuts against an inner peripheral surface of the cover body when the pair of housings is fitted together.

11. The connector waterproofing structure according to claim 1, wherein the second annular member is deformed by a negative pressure inside the cavity such that the second annular member presses on the first annular member.

12. The connector waterproofing structure according to claim 11, wherein the second annular member has an umbrella shape which is widened toward the first annular member, the first annular member includes an end surface that has a fringe, and an inner peripheral surface of the second annular member abuts against the fringe of the end surface of the first annular member.

13. The connector waterproofing structure according to claim 11, wherein the second annular member has an umbrella shape which is tapered toward the first annular member, and a distal end of the second annular members abuts against an outer peripheral surface of the first annular member which is widened from the distal end toward a base end of the first annular members.

14. The connector waterproofing structure according to claim 11, wherein each of the annular members has an umbrella shape which widen toward each other.

15. The connector waterproofing structure according to claim 14, wherein each of annular members includes a distal end surface that abut against each other, and the annular members are deformed and press on each other when the inside of the cavity has a negative pressure.

16. The connector waterproofing structure according to claim 1, wherein the second annular member is an inside annular part and the first annular member is an outside annular part which are fitted together with each other at the openings, and the outside annular part includes an inclined inner peripheral surface against which a distal end of the inside annular part abuts, and has a rigidity higher than that of the inside annular part.

17. The connector waterproofing structure according to claim 16, wherein the second one of the housings includes a tubular part which surrounds a portion where the inside annular part and the outside annular part abut against each other, and into which the first one of the housings is inserted, the tubular part is provided with an arm piece which is cut axially and extends forward into a cantilever shape, and the arm piece is formed to have a locking part which engages with the outer peripheral surface of the first one of the housings to lock the first one of the housings.

* * * * *